US009233774B2

(12) United States Patent
Swart et al.

(10) Patent No.: US 9,233,774 B2
(45) Date of Patent: Jan. 12, 2016

(54) PACKAGING FOR PLUMBING FIXTURES

(71) Applicant: Kohler Co., Kohler, WI (US)

(72) Inventors: Peter W. Swart, Oostburg, WI (US); Michael J. Pagel, Fond Du Lac, WI (US); Lawrence Duwell, Adell, WI (US); Chad Jorgensen, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/320,269

(22) Filed: Jun. 30, 2014

(65) Prior Publication Data

US 2014/0312105 A1 Oct. 23, 2014

Related U.S. Application Data

(63) Continuation of application No. 13/543,457, filed on Jul. 6, 2012, now Pat. No. 8,763,803.

(60) Provisional application No. 61/505,428, filed on Jul. 7, 2011.

(51) Int. Cl.
*B65D 85/64* (2006.01)
*B65D 5/355* (2006.01)
(Continued)

(52) U.S. Cl.
CPC ..... *B65D 5/0005* (2013.01); *B65D 5/029* (2013.01); *B65D 5/0281* (2013.01);
(Continued)

(58) Field of Classification Search
CPC ..... B65D 5/005; B65D 5/0281; B65D 5/029; B65D 5/3628; B65D 5/42; B65D 5/445; B65D 5/4608; B65D 5/5035; B65D 77/42; B65D 85/64; B65D 2585/643
USPC ..... 206/320–325, 521, 586–594; 229/108–110, 117.05, 164.2, 117.07, 229/117.08
See application file for complete search history.

(56) References Cited

U.S. PATENT DOCUMENTS

D28,639 S 5/1898 Gere
756,311 A 4/1904 Adams
(Continued)

FOREIGN PATENT DOCUMENTS

DE 3925490 2/1990
DE 202008008166 8/2008
(Continued)

OTHER PUBLICATIONS

Notice of Allowance for Design U.S. Appl. No. 29/396,965, date mailed May 14, 2012, 10 pages.
(Continued)

*Primary Examiner* — Bryon Gehman
(74) *Attorney, Agent, or Firm* — Foley & Lardner LLP

(57) ABSTRACT

A box for a plumbing fixture includes first and second side panels, an end panel, and first and second corner panels, which are interconnected at parallel joints. In a first configuration, the box is collapsed and generally planar, the first side panel being folded at a central crease closer to a forward end than a rearward end thereof, and the second side panel being folded at a central crease closer to a forward end than a rearward end thereof. In a second configuration, the box is expanded such that (a) a cavity is defined between the first side, second side, end, first corner, and second corner panels, (b) the first and second side panels are generally planar, and (c) a sum of angles between the end and first corner panels and between the end panel and second corner panels is greater than 180 degrees.

19 Claims, 57 Drawing Sheets

(51) Int. Cl.

| | |
|---|---|
| ***B65D 5/02*** | (2006.01) |
| ***B65D 5/36*** | (2006.01) |
| ***B65D 5/44*** | (2006.01) |
| ***B65D 5/468*** | (2006.01) |
| ***B65D 5/50*** | (2006.01) |
| ***B65D 77/04*** | (2006.01) |

(52) U.S. Cl.

CPC ..... *B65D 5/3628* (2013.01); *B65D 5/445* (2013.01); *B65D 5/4608* (2013.01); *B65D 5/5035* (2013.01); *B65D 77/042* (2013.01); *B65D 85/64* (2013.01); *B65D 2585/643* (2013.01)

(56) References Cited

U.S. PATENT DOCUMENTS

| | | | | |
|---|---|---|---|---|
| 901,695 | A | | 10/1908 | Davis |
| 1,425,549 | A | | 8/1922 | Scruby |
| 1,841,025 | A | | 1/1932 | Gomes |
| 1,985,111 | A | | 12/1934 | Shofer et al. |
| 2,077,173 | A | | 4/1937 | Holy |
| 2,091,291 | A | | 8/1937 | Ringler |
| 2,314,631 | A | | 3/1943 | Ray |
| 2,453,574 | A | | 11/1948 | Hill |
| 2,509,447 | A | | 5/1950 | Prawdzik |
| 2,565,188 | A | | 8/1951 | Welshenbach |
| 2,726,803 | A | | 12/1955 | Ketler |
| 2,826,350 | A | | 3/1958 | Marx |
| 3,333,685 | A | | 8/1967 | Pezdek |
| 3,526,352 | A | | 9/1970 | Swett |
| 3,700,161 | A | | 10/1972 | Bundy |
| 3,907,194 | A | | 9/1975 | Davenport et al. |
| 4,008,804 | A | | 2/1977 | Poggiali |
| 4,119,266 | A | | 10/1978 | Dempster |
| 4,260,100 | A | | 4/1981 | Hoffman |
| 4,283,001 | A | * | 8/1981 | Meyers ..... 229/110 |
| 4,289,267 | A | | 9/1981 | Mayea |
| 4,359,182 | A | | 11/1982 | Perkins, Jr. |
| 4,361,267 | A | | 11/1982 | Wozniacki |
| 4,386,729 | A | | 6/1983 | Schmidt |
| 4,511,080 | A | | 4/1985 | Madsen et al. |
| 4,549,690 | A | | 10/1985 | Rosenburg |
| 4,717,022 | A | | 1/1988 | Combs |
| 4,792,084 | A | | 12/1988 | Dreeszem |
| 4,850,506 | A | | 7/1989 | Heaps, Jr. et al. |
| 4,856,705 | A | | 8/1989 | Carr et al. |
| 4,899,927 | A | | 2/1990 | Straub et al. |
| D328,168 | S | | 7/1992 | Bartle |
| D337,270 | S | * | 7/1993 | Brockman ..... D9/430 |
| 5,244,093 | A | | 9/1993 | Carmichael et al. |
| 5,259,550 | A | | 11/1993 | Kuchenbecker |
| 5,531,375 | A | | 7/1996 | Palm |
| 5,533,666 | A | | 7/1996 | Cromwell |
| 5,542,541 | A | | 8/1996 | Smith |
| 5,562,227 | A | | 10/1996 | Takezawa et al. |
| 5,749,489 | A | | 5/1998 | Benner et al. |
| D395,004 | S | | 6/1998 | Shamoon |
| 5,878,946 | A | | 3/1999 | Frerot et al. |
| 5,915,617 | A | | 6/1999 | Gasper |
| 5,921,465 | A | | 7/1999 | Garton |
| 5,950,911 | A | | 9/1999 | Naughton et al. |
| 6,237,838 | B1 | | 5/2001 | Bradenbaugh |
| 6,446,859 | B1 | | 9/2002 | Holladay |
| 6,588,651 | B2 | | 7/2003 | Quaintance |
| 6,783,058 | B2 | | 8/2004 | Quaintance |
| D495,598 | S | | 9/2004 | Smith |
| D506,670 | S | | 6/2005 | Borkoski |
| 6,932,266 | B2 | | 8/2005 | Jones et al. |
| 7,090,115 | B2 | | 8/2006 | Pierce |
| D528,926 | S | | 9/2006 | Blin |
| D538,643 | S | * | 3/2007 | Babbino et al. ..... D9/430 |
| 7,350,670 | B2 | | 4/2008 | Steeves et al. |
| 7,434,721 | B2 | | 10/2008 | Feltz |
| D588,452 | S | | 3/2009 | Rotta |
| 7,581,672 | B1 | | 9/2009 | Keefe |
| 7,654,440 | B2 | | 2/2010 | Quaintance et al. |
| 7,690,554 | B2 | | 4/2010 | Zacher et al. |
| D617,184 | S | | 6/2010 | Sneva |
| 7,731,080 | B2 | | 6/2010 | Zacher et al. |
| 7,806,313 | B2 | | 10/2010 | Philips |
| D628,884 | S | | 12/2010 | Smith |
| D640,133 | S | | 6/2011 | Jones et al. |
| 8,011,564 | B2 | * | 9/2011 | Garner ..... 229/110 |
| D668,144 | S | | 10/2012 | Swart et al. |
| D668,951 | S | | 10/2012 | Voelker |
| 2002/0148883 | A1 | | 10/2002 | Timbrook et al. |
| 2003/0024971 | A1 | | 2/2003 | Jones et al. |
| 2005/0139645 | A1 | | 6/2005 | Shean et al. |
| 2005/0284922 | A1 | | 12/2005 | Feltz |
| 2006/0027638 | A1 | | 2/2006 | Jones et al. |
| 2006/0180642 | A1 | | 8/2006 | Zacher et al. |
| 2007/0063002 | A1 | | 3/2007 | Zacher et al. |
| 2007/0228119 | A1 | | 10/2007 | Barner |
| 2010/0044423 | A1 | | 2/2010 | Graham et al. |
| 2010/0065620 | A1 | | 3/2010 | Smith |
| 2010/0163609 | A1 | | 7/2010 | Bull |
| 2010/0230479 | A1 | | 9/2010 | Graham et al. |

FOREIGN PATENT DOCUMENTS

| | | | | |
|---|---|---|---|---|
| EP | 570023 | A2 | * | 11/1993 |
| JP | 08-119254 | | | 5/1996 |
| JP | 2007-186235 | | | 7/2007 |
| JP | 2009-241937 | | | 10/2009 |
| JP | 2011251705 | A | * | 12/2011 |
| WO | WO98/56665 | | | 12/1998 |

OTHER PUBLICATIONS

Non-Final Office Action for Design U.S. Appl. No. 29/430,641, date mailed Nov. 2, 2012, 11 pages.

Notice of Allowance for Design U.S. Appl. No. 29/430,642, date mailed Nov. 15, 2012, 15 pages.

International Search Report and Written Opinion for International Application No. PCT/US2012/045802, date of mailing Jan. 15, 2013, 18 pages.

Invitation to Pay Additional Fees and, Where Applicable, Protest Fee for International Application No. PCT/US2012/045802, date of mailing Oct. 30, 2012, 5 pages.

International Preliminary Report on Patentability regarding App. No. PCT/US2012/045802 dated Jan. 16, 2014.

* cited by examiner

PACKAGING FOR PLUMBING FIXTURES

CROSS-REFERENCE TO RELATED PATENT APPLICATIONS

This application is a continuation of U.S. patent application Ser. No. 13/543,457 (now U.S. Pat. No. 8,763,803), filed Jul. 6, 2012, which claims priority to and the benefit of U.S. Provisional Application 61/505,428, filed Jul. 7, 2011, the disclosures of which are both incorporated herein by reference in their entirety.

BACKGROUND

Conventional packaging for plumbing fixtures, such as toilets and sinks, typically have a rectangular or square shape. For example, the packaging for a plumbing fixture can be a rectangular box 10, as shown in FIG. 1A.

Such conventional packaging may not provide an efficient use of packaging space. FIGS. 1B and 1C show an example of a rectangular box with its lid open to reveal a toilet inside the box, including a tank box 30. Panels 20 are inserted in the ends of the box to hold the tank box 30 and toilet 40 in place. However, there is a large amount of unused space 22, such as in the corners of the box.

In such conventional packaging, the corners of the box provide a large degree of the compression strength of the box, which measures the ability of a box to withstand compressive loads when such boxes are stacked on top of one another. Internal supports can be added to the box to reinforce its strength, but the addition of such internal supports increase the cost of such packaging.

SUMMARY

According to an exemplary embodiment a box for a plumbing fixture includes a first side panel, a second side panel, an end panel, a first corner panel, and a second corner panel, which are interconnected to each other at parallel joints. The first side panel and the end panel are connected to opposite ends of the first corner panel, the first side panel having a forward end connected to the first corner panel and having a rearward end. The first corner panel and the second corner panel are connected to opposite ends of the end panel. The second side panel and the end panel are connected to opposite ends of the second corner panel, the second side panel having a forward end connected to the second corner panel and having a rearward end. In a first configuration, the box is in a collapsed state in which the box is generally planar, the first side panel being folded at a central crease that is closer to the forward end than the rearward end thereof, and the second side panel being folded at a central crease that is closer to the forward end than the rearward end thereof. In a second configuration, the box is in an expanded state in which (a) a cavity is defined between the first side panel, the second side panel, the end panel, the first corner panel, and the second corner panel, (b) the first side panel and the second side panel are generally planar, and (c) a sum of angles between the end panel and the first corner panel and between the end panel and the second corner panel is greater than 180 degrees.

According to an exemplary embodiment, a box for a plumbing fixture includes at least five vertical, planar panels which form a cavity therebetween. The planar panels define a horizontal outer periphery of the box in a fully-expanded state, the horizontal outer periphery being symmetric about only one vertical plane.

According to an exemplary embodiment, a packaged plumbing fixture includes a box, a plumbing fixture, and a packaging insert. The box comprises a plurality of generally vertical sides that are interconnected to cooperatively define a cavity for containing a plumbing fixture. The plurality of sides include a first side and a second side that are connected to opposite ends of a third side. The packaging insert includes first and second generally planar surfaces. The packaging insert is positioned within the cavity with each of the first and second generally planar surfaces arranged generally parallel with and proximate to one of the sides. A sum of angles between the third side and the first side and between the third side and the second side is greater than 180 degrees.

According to an exemplary embodiment, a box for a plumbing fixture generally includes a top, a bottom, and a plurality of panels interconnected at parallel joints. The plurality of panels include at least a first side panel and a second side panel. In a first configuration, the box is in a collapsed state in which the box is generally planar with the first and second side panels each being folded at a central crease. In a second configuration, the box is in an expanded state in which a cavity is defined between the top, bottom, and plurality of side panels. The cavity is configured to receive the plumbing fixture therein. In the second configuration, the first and second side panels are generally parallel to each other and are spaced apart to define a width of the box.

DETAILED DESCRIPTION

Figure 1A:
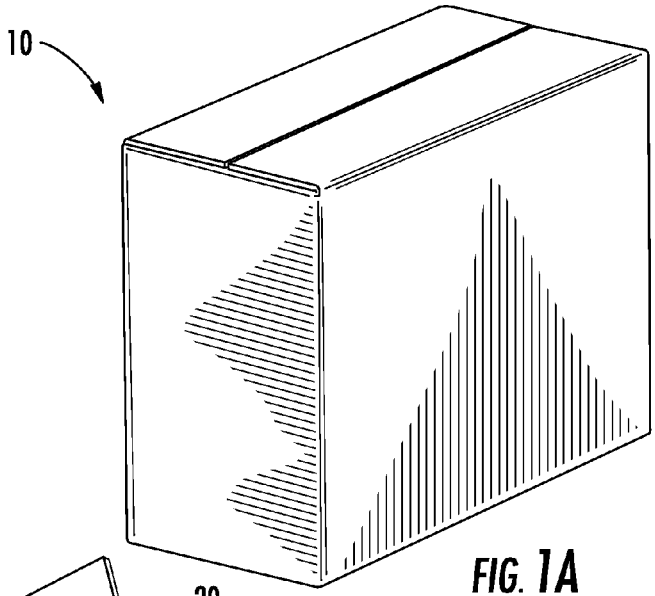
FIG. 1A (PRIOR ART)
FIG. 1A is a top perspective view of a conventional rectangular box.
Figure 1B:
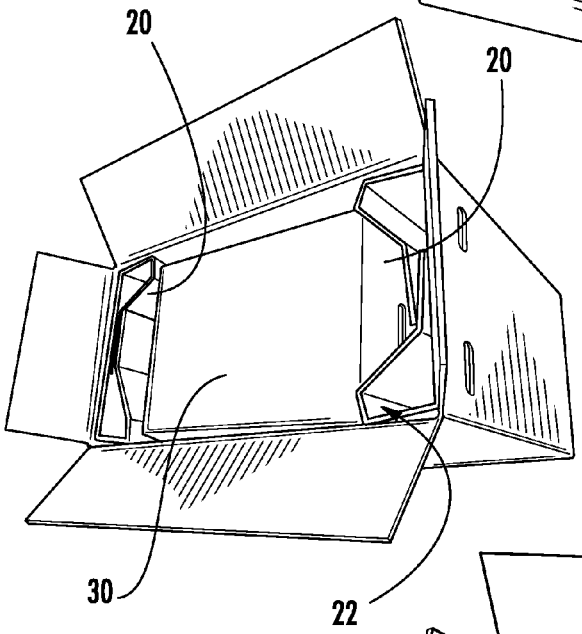
FIG. 1B (PRIOR ART)
FIG. 1B is a top perspective view of the conventional rectangular box of FIG. 1A with its lid open.
Figure 1C:
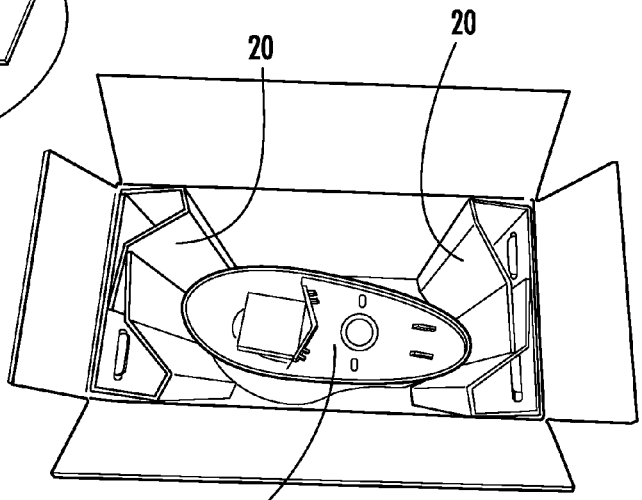
FIG. 1C (PRIOR ART)
FIG. 1C is another top perspective view of the conventional rectangular box of FIG. 1A with its lid open, but with an inner tank box removed.
Figure 2:
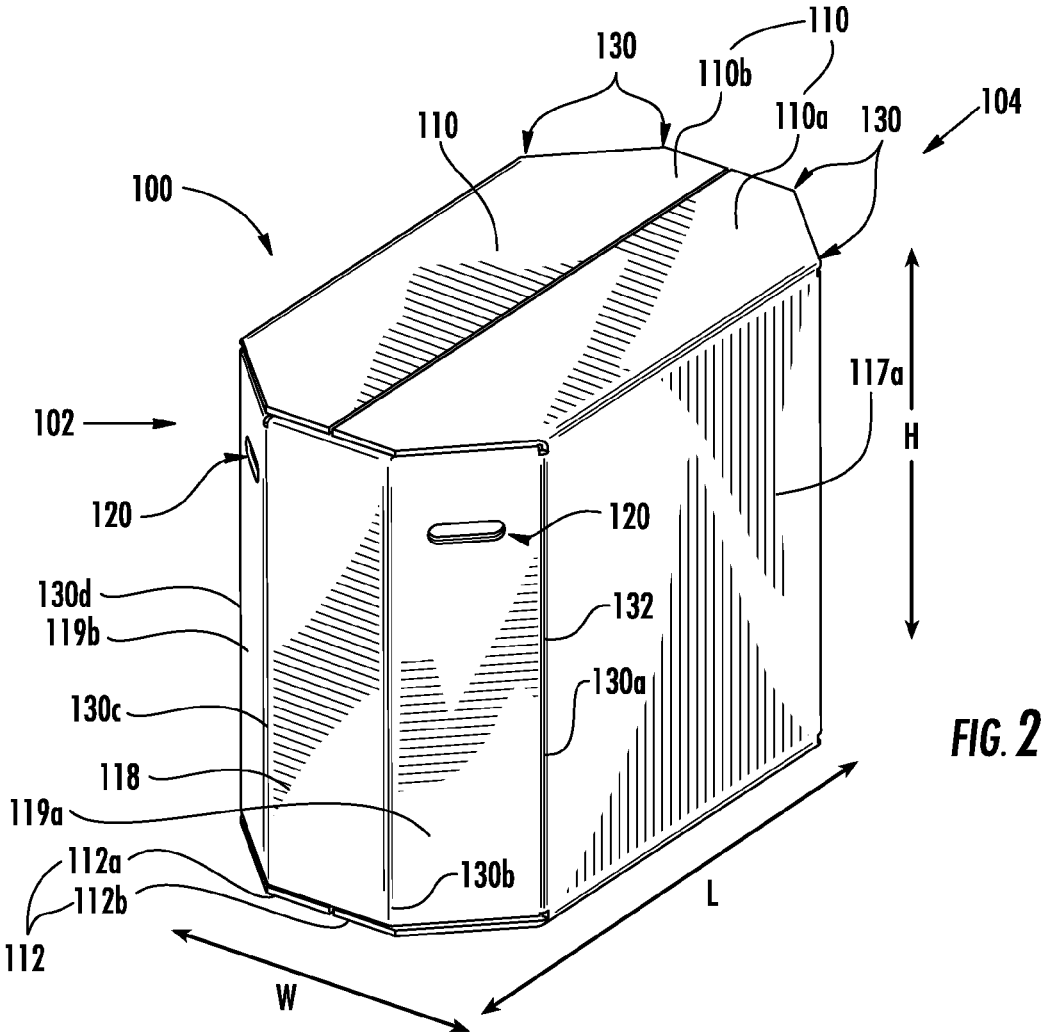
FIG. 2 is a top perspective view of a packaging container or box according to an exemplary embodiment.
Figure 3:
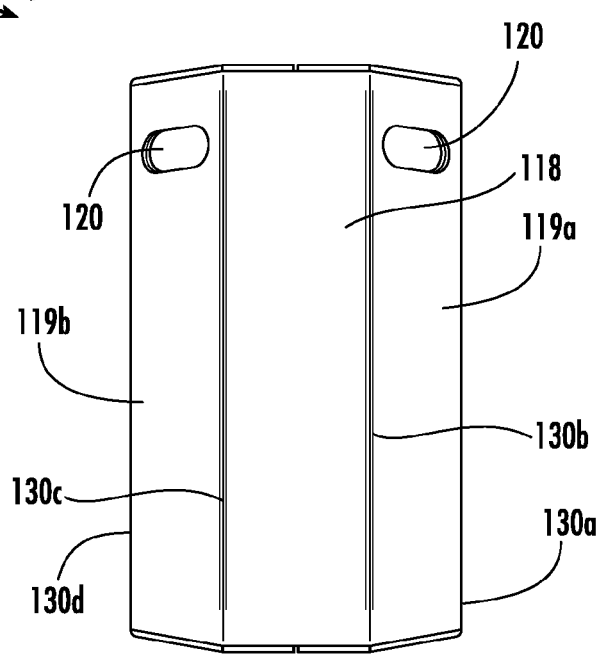
FIG. 3 is an end view of the packaging box of FIG. 2.
Figure 64:
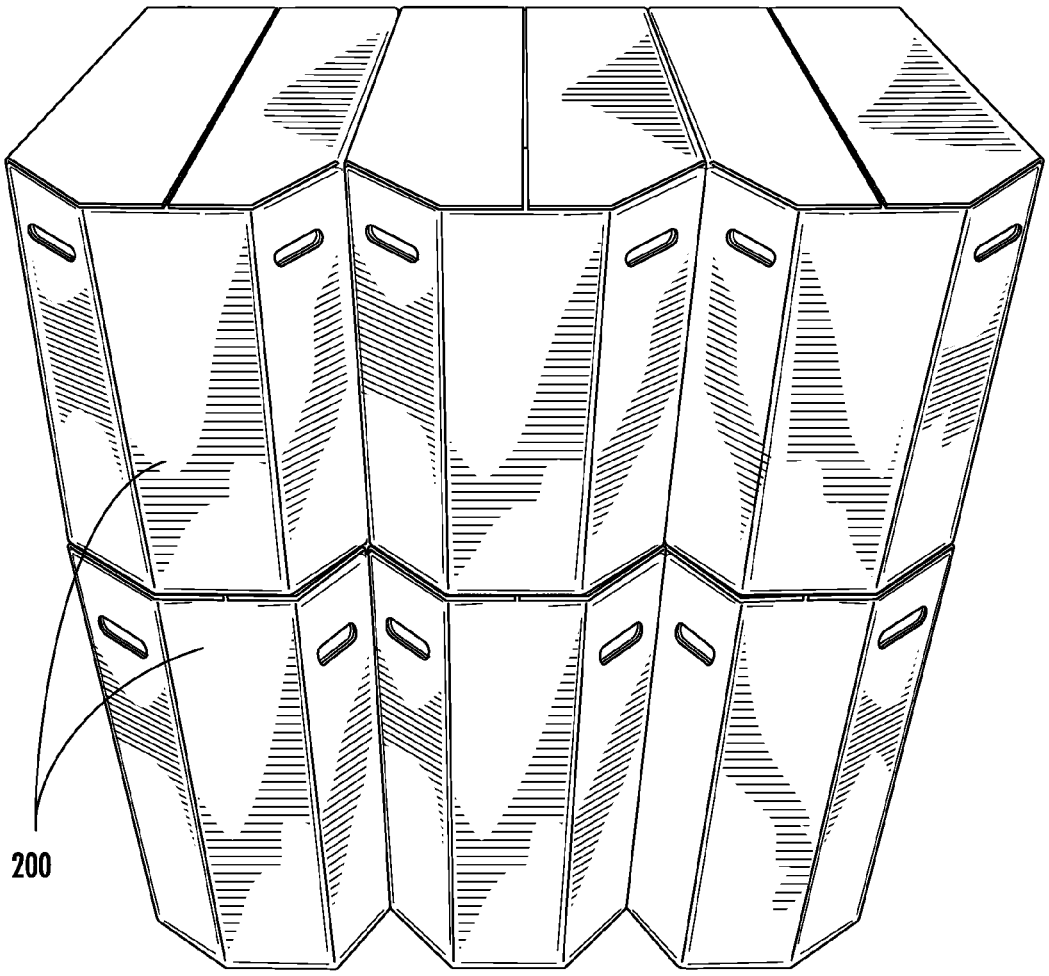
FIG. 64 is a top perspective view of a plurality of packaging boxes stacked upon one another according to an exemplary embodiment.

Referring generally to FIGS. 2 through 64, packaging or a packaging system for a plumbing fixture is shown according to various exemplary embodiments. The packaging disclosed herein may have an improved compression strength relative to conventional packaging for plumbing fixtures. The packaging disclosed herein may also use less material than conventional packaging for plumbing fixtures, which in turn may reduce cost. Further still, the packaging disclosed herein may have improved aesthetic qualities, for example with respect to product marketing and advertising, relative to conventional packaging for plumbing fixtures.

For exemplary purposes only, the packaging will be described in detail herein as a packaging box that is configured to receive, contain, support, transport and/or display a plumbing fixture, and more specifically a toilet. The description of the packaging in this manner is not intended to be limiting. The packaging may be equally suitable for receiving, containing, supporting, transporting and/or displaying other types of plumbing fixtures, such as bidets, lavatories, urinals, pedestals, etc., as well as products that are not plumbing fixtures.

FIG. 2 shows an example of a packaging box 100 (e.g., packaging, box, carton, container, etc.), according to an exemplary embodiment of the packaging system. The packaging box generally includes a top 110, a bottom 111, and a plurality of sides 117-119 (e.g., walls, faces, panels, etc.), which cooperatively define a cavity 180 (e.g., compartment or enclosure) for receiving or storing a plumbing fixture 150 therein.

According to an exemplary embodiment, the packaging box 100 includes one or more flaps or panels 110*a*, 110*b*, which form the top 110 (e.g., lid, upper enclosure, upper panel(s), etc.) at an upper end of the packaging box 100. The packaging box 100 can also include one or more flaps or panels 111*a*, 111*b*, which form the bottom 111 (e.g., lid, upper enclosure, lower panel(s), etc.) at a lower end of the packaging box 100. The packaging box 100 can also include gripping elements to assist with lifting the box, such as apertures 120 provided in, and extending through, the walls of the packaging box 100 (not shown in FIG. 9).

According to an exemplary embodiment, the packaging box 100 includes a plurality of generally planar sides (e.g., 117-119) that are interconnected at generally vertical corners 130. Inner surfaces of the planar sides generally define the outer perimeter of the cavity 180. For example, the packaging box 100 includes more than four sides and, thus has more than four vertical corners 130, in contrast with a conventional rectangular box. This results in the packaging box 100 having multiple corners 130, which may, in at least some embodiments, advantageously increase the compression strength of the packaging box 100.

According to an exemplary embodiment, a packaging box 100 having eight vertical corners 130, as shown in the example of FIG. 2, was found to have an approximately 10 percent increase in compression strength in comparison to the compression strength of a conventional rectangular box. Increasing the compression strength of a packaging box 100 by increasing the number of corners 130 may make the packaging box 100 more resistant to damage than a conventional rectangular box. For example, the denting or buckling of a vertical corner in a conventional rectangular box may lead to the collapse of the packaging box. The packaging box 100 reduces this likelihood by having a number of vertical corners 130 greater than four and improving the compression strength. Because the packaging box 100 is more resistant to damage, it is possible that less internal support may be necessary for the box. For example, according to an exemplary embodiment, a packaging box 100 having at least eight vertical corners 130, as shown in the example of FIG. 2, and can be capable of withstanding a peak load of approximately 2500 pounds. However, the packaging box disclosed herein is not limited to eight vertical corners and can have any number of vertical corners greater than four vertical corners 130, such as five, six (see e.g., FIGS. 56-64), seven, or more than eight vertical corners 130.

A vertical corner 130 of a packaging box 100 can be shared by both the top and bottom surfaces of the packaging box 100. For example, a fold or line 132 extending between the top and bottom of a packaging box 100 can share the same vertical corner 130.

As shown in the example of FIGS. 2-10, the packaging box 100 includes at a first end 102 side panels or faces 117*a*, 117*b*, which are interconnected by two corner or angled panels or faces 119*a*, 119*b* and an end panel or face 118 (e.g., at a forward end 102 of the packaging box 100). For example, the side panel 117*a* is connected to the corner panel 119*a* at corner 130*a*, the corner panel 119*a* is connected to the end panel 118 at corner 130*b*, the end panel 118 is connected to the corner panel 119*b* at corner 130*c*, and the corner panel 119*b* is connected to side panel 117*b* at corner 130*d*. According to an exemplary embodiment, a second end 104 may similarly include corner panels 119*a*, 119*b*, and an end panel 118 to interconnect the side panels 117*a*, 117*b* at a rearward end 104 of the packaging box 100, such that the packaging box 100 includes eight vertical corners, such as four vertical corners 130*a*-130*d* provided at each end 102, 104 of the packaging box 100. According to another exemplary embodiment as shown in FIGS. 56-64, a first or forward end 202 of a packaging box 200 may similarly include side panels 217*a*, 217*b* interconnected by corner panels 219*a*, 219*b* and an end panel 218, while at a second or rearward end 204, the side panels 217*a*, 217*b* are interconnected by a single end panel 218, such that the packaging box 200 includes six vertical corners 230.

Figure 4:
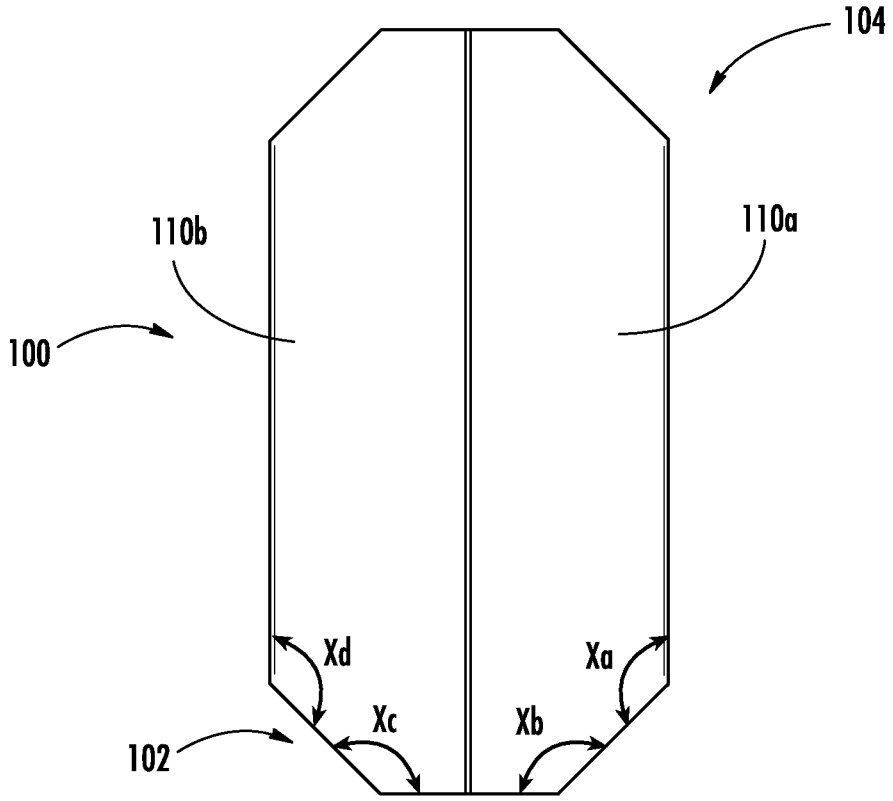
FIG. 4 is a top view of the packaging box of FIG. 2.
Figure 5:
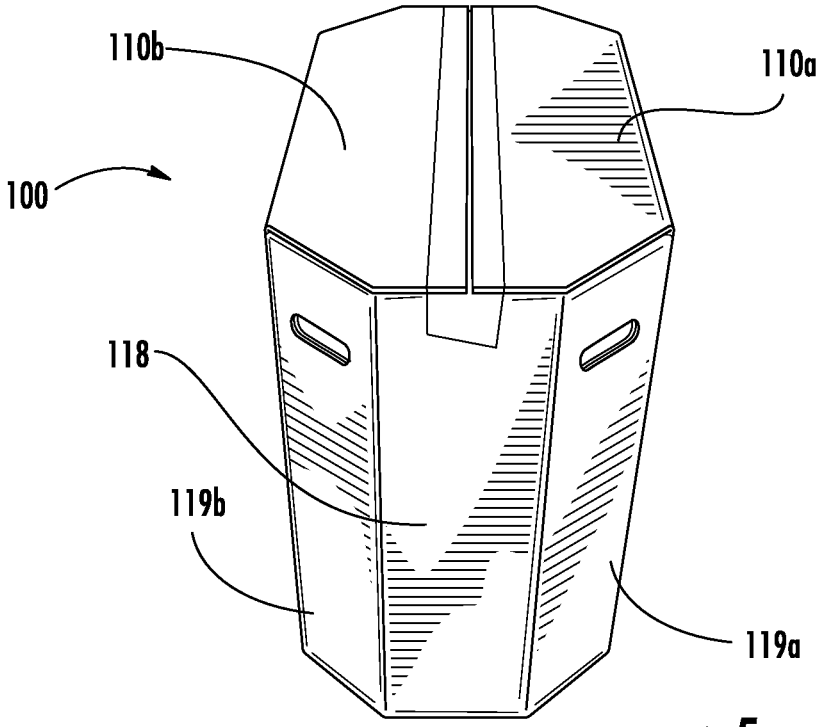
FIG. 5 is an angled top view of the packaging box of FIG. 2.

The increased number of vertical corners in the packaging box 100 can result in each vertical corner 130 having an angle X of greater than 90 degrees (i.e., the interior angle between adjacent panels), as shown in the example of FIG. 4. For example, a box having eight vertical corners can be provided, with each vertical corner having an angle X of approximately 135 degrees (e.g., within approximately 2 or 3 degrees). According to a still further exemplary embodiment, a packaging box 100 has a plurality of vertical corners 130 such that the angle X of the vertical corners 130 is greater than or less than 135 degrees, but still greater than 90 degrees.

According to an exemplary embodiment, the side panels 117*a*, 117*b* are arranged generally parallel to each other, and the end panel 118 is arranged generally perpendicular to the side panels 117*a*, 117*b*. The corner panels 119*a*, 119*b* are arranged at non-normal angles relative to the side panels 117*a*, 117*b*, and the end panel 118. For example, the angles $X_a$, $X_b$, $X_c$, $X_d$ between the side panels 117*a*, 117*b*, corner panels 119*a*, 119*b*, and end panel 118 (i.e., at corners 130*a*-130*d*) are between approximately 110 and 160 degrees, such as between approximately 120 and 150 degrees (e.g., between approximately 130 and 140 degrees, or approximately 135 degrees). For example, the sum of the angles $X_b$ and $X_c$ (i.e., between the end panel 118 and the corner panel 119*a* and between the end panel 118 and the corner panel 119*b*) is between approximately 180 and 360 degrees, such as between approximately 240 and 300 degrees (e.g., between 260 and 280 degrees, or approximately 270 degrees). According to other exemplary embodiments, the panels 117-119 may be arranged at other angles relative to each other (e.g., with side panels 117*a*, 117*b* not being parallel to each other).

The packaging box 100 can be provided in a variety of shapes and sizes, with various numbers of vertical corners, for example, according to the type, size, and/or shape of the plumbing fixture (e.g., toilet, bidet, urinal, etc.) to be placed in the packaging box 100. According to an embodiment, the packaging box 100 may be configured to receive a toilet, therein, such as a two-piece toilet having a tank provided disconnected from a bowl, and can have an overall length L of between approximately 27.0 and 33.0 inches, more particularly a length L of between approximately 28.0 and 32.0 inches, or more particularly a length L of between approximately 28.5 and 31.5 inches. The packaging box 100 can have an overall width W of between approximately 14.0 and 19.0 inches, more particularly a width W of between approximately 14.5 and 18.5 inches, or more particularly a width W of between approximately 15.0 and 18.4 inches. The packaging box 100 can have a height H of between approximately 22.5 and 29.0 inches, more particularly a height H of between approximately 23.0 and 28.5 inches, or more particularly a height H of between approximately 23.5 and 27.8 inches. These various ranges of length, width, and height may be used in various combinations with one another. According to another exemplary embodiment, such as shown in FIGS. 56-64 the packaging box 200 may be configured to receive a single-piece toilet (i.e., with the tank connected to the toilet), two-piece toilet, or a urinal, and may have a width W of between approximately 14 and 25 inches, such as between approximately 18 and 22 inches (e.g., approximately 19.5 or 20.4 inches), may have a length L of between approximately 27 and 33 inches, such as between approximately 28 and 29 inches (e.g., approximately 28.4 inches) or between approximately 30 and 31 inches (e.g., approximately 30.8 inches), and may have a height of between approximately 10 and 35 inches, such as between approximately 12 and 18 inches (e.g., approximately 15 inches) or between approximately 27 and 31 inches (e.g., approximately 28.7 inches).

According to an exemplary embodiment, the side panels 117*a*, 117*b* (or 217*a*, 217*b*) may have a width $W_S$ of between approximately 12 and 29 inches, such as between approximately 18 and 25 inches (e.g., approximately 22.4 or 24.8 inches). The corner panels 119*a*, 119*b* may have a width $W_C$ of between approximately 3 and 11 inches, such as between approximately 5 and 10 inches (e.g., approximately 8.6, 7.9, 7.6, or 5.8 inches). The end panel 118 may have a width $W_E$ of between approximately 3 and 11 inches, such as between approximately 5 and 10 inches (e.g., 8.6, 7.9, 7.6, 5.8 inches). For example, each corner panel 119*a*, 119*b* may have a width generally equal to that of the end panel to which they are attached (e.g., within approximately 1 inch). Further, the sum of the widths $W_C$ and $W_E$ of the corner and end panels 119*a*, 119*b*, 118 may be greater than the overall width W of the packaging box 100. The width of the end panel 218 $W_{EB}$ at the rearward or back end 204 of the packaging box 200 may be generally equal to the overall width W of the packaging box 200.

According to an exemplary embodiment, each of the panels 117-119 are configured to extend generally from the top 110 to the bottom 111, or otherwise have a height or length approximately equal to the overall height H of the packaging box 100.

According to other exemplary embodiments, the dimensions of the packaging box 100 and its various components (e.g., panels, flaps, corners, etc.) may be configured in different manners, such as being larger, smaller, or in different combinations of dimensions, for example, according to the size, shape, and other characteristics of the plumbing fixture and/or according to other packaging considerations.

According to an exemplary embodiment, the apertures 120 are provided towards an upper portion of the angled faces 119. According to the embodiment illustrated, a first pair of the apertures 120 are provided in a first end (e.g., a front end) of the packaging box 100, while a second pair of the apertures 120 are provided in an opposite second end (e.g., a rear end) of the packaging box 100. Locating the apertures 120 in this manner is intended to promote relatively easy lifting of the packaging box 100 by a consumer (see, e.g., FIG. 8). According to an exemplary embodiment, the angled faces 119 on which the apertures 120 are provided are narrower than the end face 118 that separates the two angled faces 119. Configuring the packaging box 100 in this manner may create improved lifting options for packaging box 100 in comparison to a conventional wider ended rectangular packaging, for example, by providing handles that are angled toward each other. As shown in FIGS. 56-64, in embodiments having a single end panel 218 at a rearward end 204 of the packaging box 200, apertures 263 may be provided in the single end panel 218, so as to be arranged generally perpendicular to the side panels 217*a*, 217*b*.

The apertures 120 are shown as being substantially oblong in shape, having widths that are greater than their heights. According to the various alternative embodiments, the apertures 120 may be formed into any of a number of suitable shapes. For example, see the apertures in embodiments illustrated in FIGS. 14-64. According to further alternative embodiments, any number of the apertures 120 may be formed in the packaging box 100 in any of a number of positions. Further still, the packaging box 100 may include other types of gripping elements, such as straps, handles, bails, etc., in addition to, or instead of, the apertures 120.

According to an exemplary embodiment, the packaging box 100 includes top flaps or panels 110*a*, 110*b*, which form the top 110. The top panels 110*a*, 110*b* are connected to the side panels 117*a*, 117*b* at horizontal corners 131*a* and are configured to fold inward to generally close the cavity 180. The packaging box 100 may also include corner flaps 114 that are connected to each of the corner panels 119*a*, 119*b* at horizontal corners 131*b* and are configured to fold inward (e.g., underneath top panels 110*a*, 110*b*). The packaging box 100 may also include end flaps 112 that are connected to each of the end panels 118 at horizontal corners 131*c* and are configured to fold inward (e.g., underneath top panels 110*a*, 110*b*). According to other exemplary embodiments, the top 110 and/or flaps 110*a*, 110*b*, 112, 114 may be configured in other manners (e.g., the top 110 including flaps 112 and/or 114 instead of or in addition to panels or flaps 110*a*, 110*b*; flaps 112 and/or 114 being positioned above panels 110*a*, 110*b*; with fewer flaps, such as only top panels or flaps 110*a*, 110*b*).

Figure 9:
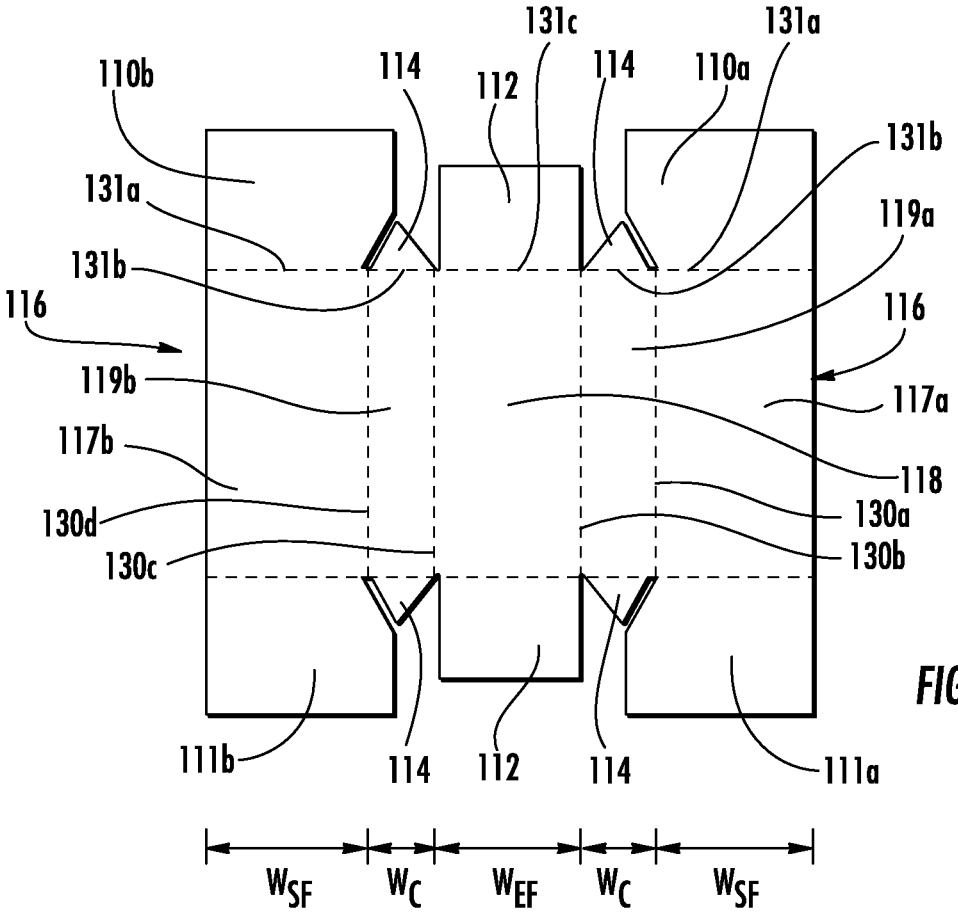
FIG. 9 is a top plan view of the packaging box in a state in which the packaging box of FIG. 2 is folded flat according to an exemplary embodiment.

As shown in FIG. 9, according to an exemplary embodiment, the packaging box 100 is configured to be provided in a folded or collapsed state in which the packaging box 100 is generally planar (e.g., having generally two layers of panels 117-119). For example, the packaging box 100 may be collapsed along central creases or fold lines 116 in the side panels 117*a*, 117*b* (see also FIG. 10). A portion of the inner surface of each side panel 117*a*, 117*b* may, therefore, touch or face a different portion of the inner surface of the same side panel 117*a*, 117*b* (i.e., such that the side panels 117*a*, 117*b* are folded onto or against themselves). Further, an inner surface of the end panel 118 at the first or forward end 102 of the packaging box 100 will touch or face the inner surface of the other end panel 118 at the second or rearward end 104 of the packaging box 100. According to exemplary embodiments having symmetrical first and second ends 102, 104, the central creases are positioned approximately half-way between a forward end and rearward end of each side panel 117*a*, 117*b*, such that the distance from the forward end to the central crease $W_{SF}$ is approximately equal to the distance from the crease to the rearward end $W_{SF}$ and is approximately equal to half the width $W_S$ of the side panel (i.e., $W_{SF}=W_{SB}=\frac{1}{2}W_S$).

Figure 61A:
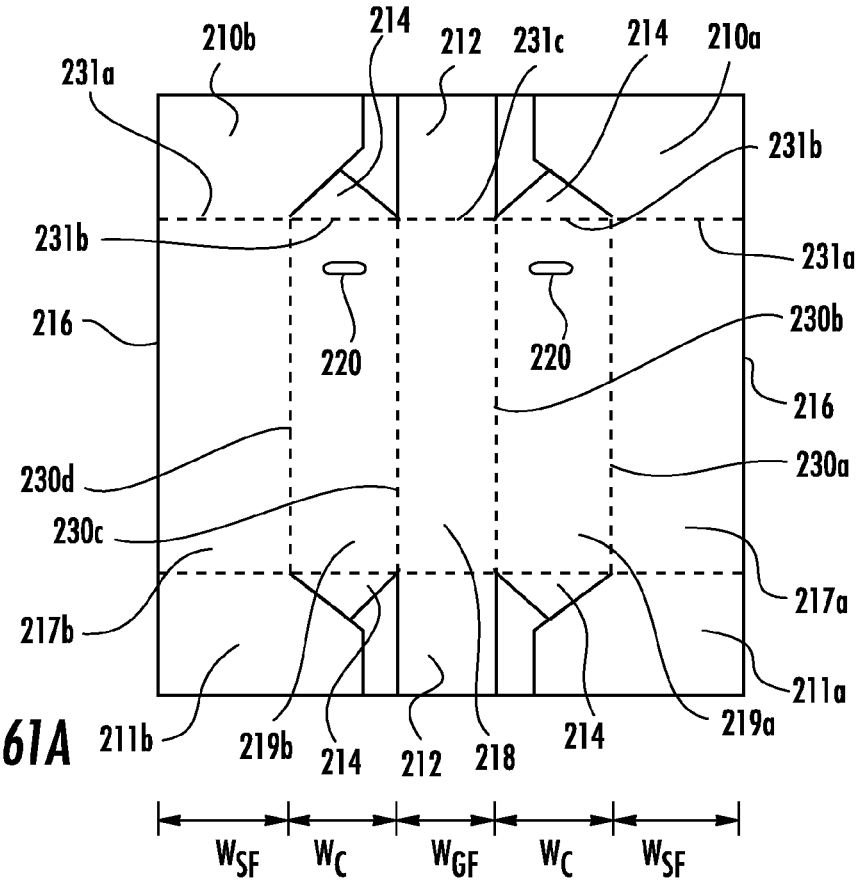
FIG. 61A is a top plan view of the packaging box in a state in which the packaging box is folded flat according to an exemplary embodiment.
Figure 61B:
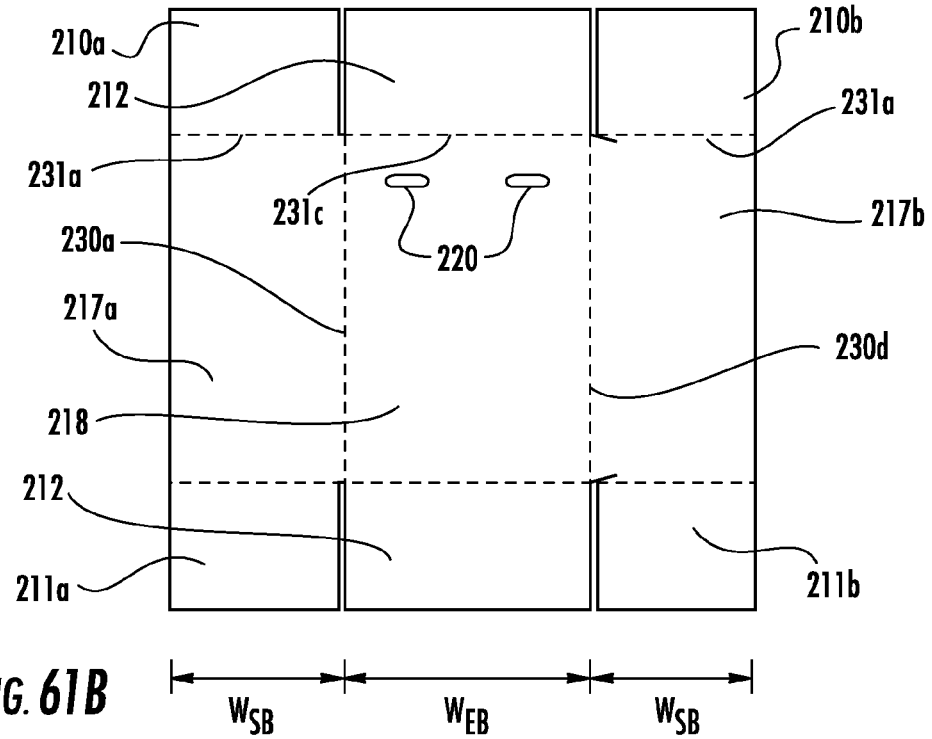
FIG. 61B is a bottom plan view of the packaging box in a state in which the packaging box is folded flat according to an exemplary embodiment.

According to exemplary embodiments that do not have symmetric first and second ends of the packaging box, the central crease of each side panel may be biased toward either the forward end or the rearward ends thereof. For example, as shown in FIGS. 61A and 61B, the packaging box 200 includes a single end panel 218 at a rearward end 204 of the packaging box 200, and the central crease 216 of each side panel 217*a*, 217*b* is biased toward the forward end thereof. The width $W_{EB}$ of the rear or back end panel 218 is less than the sum of the widths $W_{EF}$, $W_C$ of the corner and end panels 219*a*, 219*b*, 218 at the forward end 202 of the packaging box, such that the central crease 216 is biased toward the forward end of the side panel 217*a*, 217*b* (e.g., such that $W_{SF}-W_{SB}$ equals approximately $\frac{1}{2}(W_{EF}+2W_C-W_{EB})$.

Figure 6:
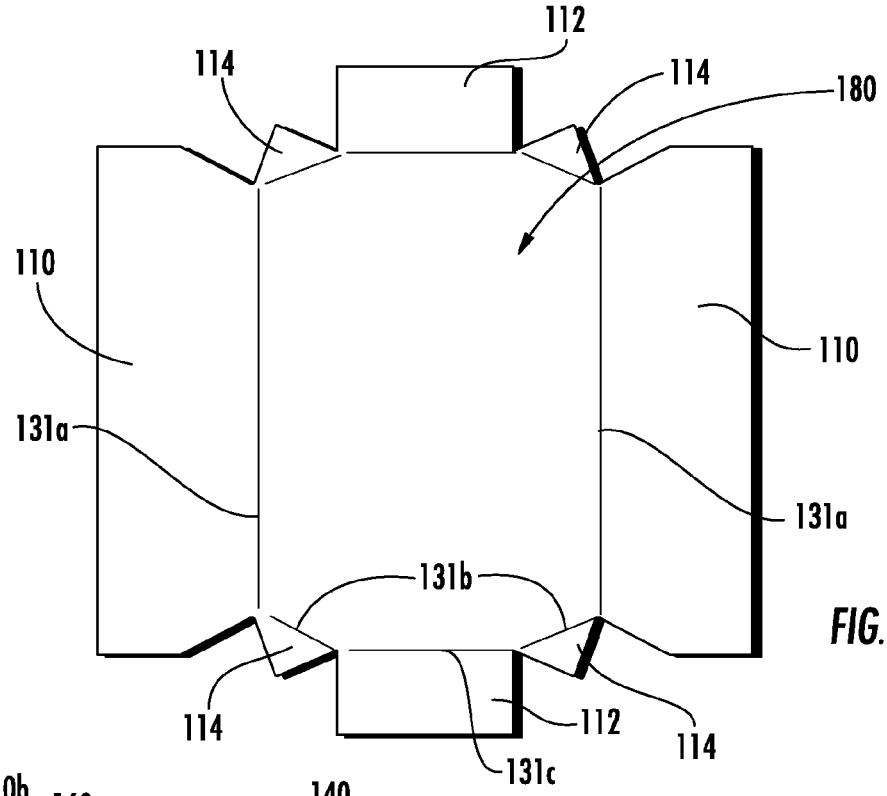
FIG. 6 is a top plan view of the packaging box of FIG. 2 with the lid in an open state.

FIG. 6 shows a top view of a packaging box 100 in an expanded state (e.g., assembled, open, etc.) defining a empty cavity 180 to receive a plumbing fixture therein. The top or lid 110 of the packaging box 100 is in an open position, according to an exemplary embodiment, with the panels of flaps 110*a*, 110*b* of the top 110 being folded generally outward. The various flaps can have the shapes shown in FIG. 6 or can have other shapes, such as shapes with rounded edges and/or corners, square shaped, and any other suitable shape.

Figure 7A:
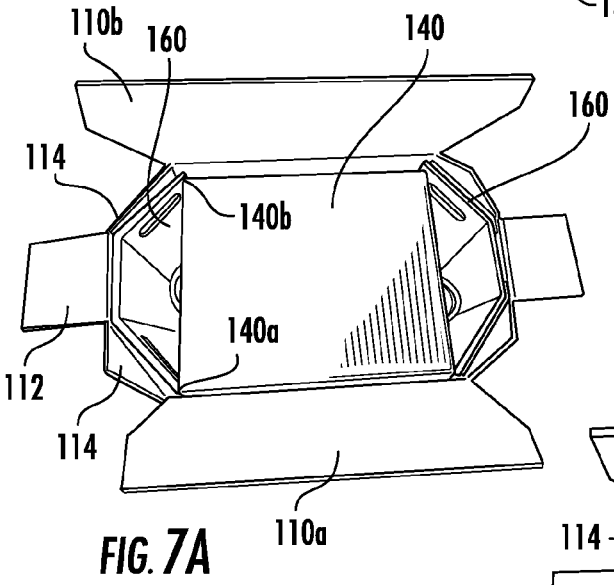
FIG. 7A is a top plan view of the packaging box of FIG. 2 with a toilet and toilet tank box inside.
Figure 7B:
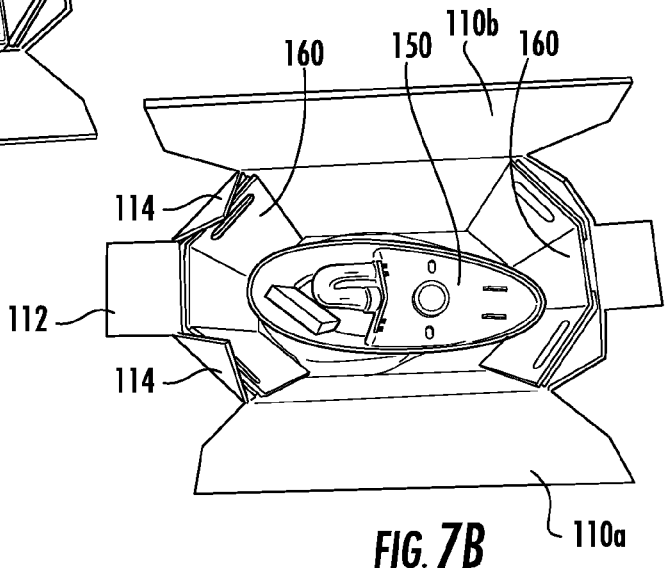
FIG. 7B is another top plan view of the packaging box of FIG. 2 with the toilet tank box removed.

According to an exemplary embodiment, the packaging system includes one or more packaging inserts that are provided within the packaging box 100. For example, the inserts may include a box 140, an end or generally vertical pad 160 (e.g., cushion, reinforcement, member, etc.), and/or a top and/or bottom or generally horizontal pad 170 (e.g., cushion, reinforcement, member, etc.). For example, FIG. 7A shows a top view of an open packaging box 100 with a toilet 150, inside, according to an exemplary embodiment, with an interior box 140 (e.g., for a tank) and two vertical pads 160 also located therein. As shown in FIG. 7A, the unique shape of the packaging box 100 (e.g., with corner panels 119*a*, 119*b*) may assist in centering and/or locating the contents of the packaging box 100, such as the toilet 150 and/or the interior box 140, and the end or vertical pads 160 may further assist with holding the contents of the packaging box 100 (i.e., retaining the contents in a generally fixed position within the packaging box 100). Thus, the packaging box 100, alone or in combination with one or more vertical pads 160, can provide improved stabilization of a product within the packaging box 100. FIG. 7B shows the packaging box 100 of FIG. 7A with the tank box 140 removed, which shows a minimal amount of unused space within the packaging box 100. As discussed in further detail below, one or more of the inserts (e.g., interior box 140, end or vertical pad 160, and/or bottom/top or horizontal pad 170) may include at least two generally straight edges or planar surfaces that are positioned generally adjacent the inner surface of one of the panels 117-119.

As shown in FIG. 7A, according to an exemplary embodiment, the interior box 140 has a generally square or rectangular cross-section and includes side walls or panels, which are generally straight or planar and which are generally parallel with each other. The interior box 140 is sized so as to be positioned between the side panels 117*a*, 117*b* of the packaging box 100 with the side walls of the interior box positioned proximate to and arranged generally parallel with the inner surfaces of the side panels 117*a*, 117*b* of the packaging box 100. The side walls of the interior box 140 may be positioned directly adjacent or in contact with the inner surfaces of the side panels 117*a*, 117*b* of the packaging box 100, or additional packing material may be placed therebetween. With the packaging box 100 and the interior box 140 being cooperatively configured (i.e., shaped and sized) in this manner, the side panels 117*a*, 117*b* engage (directly or indirectly) the sides of the interior box 140, so as to hold the interior box 140 or limit or prevent perpendicular movement of the interior box 140 relative to the side panels 117*a*, 117*b* of the packaging box 100.

According to an exemplary embodiment, the packaging box 100 is formed from a generally continuous sheet of material (e.g., cardboard, plastic, corrugated materials, etc.) with the panels 117-119 being defined by generally parallel folds or creases (e.g., that form corners 130) in the continuous sheet.

According to an exemplary embodiment, the packaging box 100 and interior box 140 are further configured (i.e., sized and shaped) to limit or prevent parallel movement of the interior box 140 relative to the side panels 117*a*, 117*b* of the packaging box 100. For example, generally vertical corners 140*a*, 140*d* of the interior box may be positioned directly adjacent to or in contact with vertical corners 130*a*, 130*d* or corner panels 119*a*, 119*b* of the packaging box 100 (or with portions of the end pad 160 positioned therebetween). Configured in this manner, the vertical corners 130*a*, 130*d* or corner panels 119*a*, 119*b* on opposite ends 102, 104 of the packaging box 100 engage (directly or indirectly) the vertical corners 140*a*, 140*d* to hold the interior box 140 therebetween.

Figure 12:
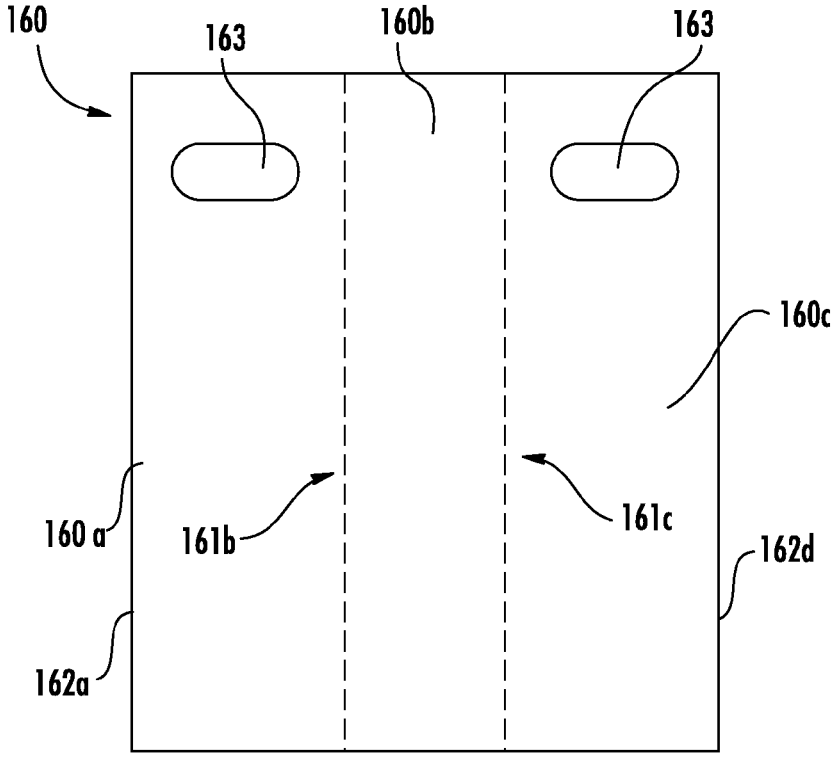
FIG. 12 is an front elevation view of an end pad according to an exemplary embodiment.

As shown in FIGS. 7A, 7B and 12, the end pad 160 is positioned generally between the inner surfaces of the panels 118, 119*a*, 119*b* and the toilet 150. According to an exemplary embodiment, the end pad 160 can be folded along vertical corners or fold lines 161*b*, 161*c* so that the end pad 160 may easily assume the shape of one of the ends 102, 104 of the packaging box 100. Such end pads 160 can be used to provide additional reinforcement of a packaging box 100 and to assist in maintaining the shape of a packaging box 100. Alternatively, the packaging box 100 can be prepared without inserting one or more end pads 160.

According to an exemplary embodiment, the end pad 160 generally includes two or more panels, such as panels 160*a*-160*c* that extend between generally vertical ends 162*a*, 162*d* and that are connected at generally vertical corners 161*b*, 161*c*. The end pad 160 is configured such that the each of the panels 160*a*-160*c* is positioned proximate to and arranged generally parallel with the inner surfaces of the panels 118, 119*a*, 119*b*. For example, the end panel 160*a* of the end pad 160 may be generally parallel with the corner panel 119*a* of the packaging box 100, the central panel 160*b* is generally parallel with the end panel 118, and the end panel 160*c* is generally parallel with the corner panel 119*b*. Furthermore, each of the panels 160*a*-160*c* of the end pad 160 may be positioned directly adjacent to and/or in contact with the inner surface of one of the panels 118, 119*a*, 119*b*. According to still further exemplary embodiments, the vertical corners 161*b*, 161*c* of the pad 160 may be arranged parallel with and/or be positioned proximate to, adjacent to, or in contact with the vertical corners 130*b*, 130*c* of the packaging box 100. Additionally, the vertical ends 162*a*, 162*b* of the end pad 160 may be arranged parallel with and/or be positioned proximate to or adjacent the vertical corners 130*a*, 130*d* of the packaging box.

According to an exemplary embodiment, the vertical ends 162*a*, 162*d* of the end pad 160 may be positioned generally adjacent vertical corners 140*a*, 140*d* of the interior box 140, such that inner surfaces of the end panels 160*a*, 160*c* and/or vertical ends 162*a*, 162*d* of the end panel 160 engage the vertical corners 140*a*, 140*d* to prevent movement of the interior box 140 within the packaging box 100.

According to an exemplary embodiment, the end pad 160 is formed from a continuous sheet of material (e.g., cardboard, plastic, corrugated materials, etc.) with the panels 160*a*-160*c* being defined by parallel folds or creases (for example that form the vertical corners 161*b*, 161*c*) in the sheet of material.

FIG. 12 further shows that, according to an exemplary embodiment, the end pad 160 may include apertures 163 corresponding to apertures 120 of a packaging box 100 so that the packaging box 100 may be more easily lifted. For example, the apertures 163 of an end pad 160 can have the same shape as apertures 120 provided in the packaging box 100 so that a user may easily insert their hands and fingers through the apertures 120, 163 of both the packaging box 100 and the end pad 160. In addition, the shape and location of the apertures 163 are not limited to that shown in the example of FIG. 12 but may have various suitable shapes and/or locations, and can have use other types of gripping elements, like the apertures 120, as discussed herein.

Figure 11:
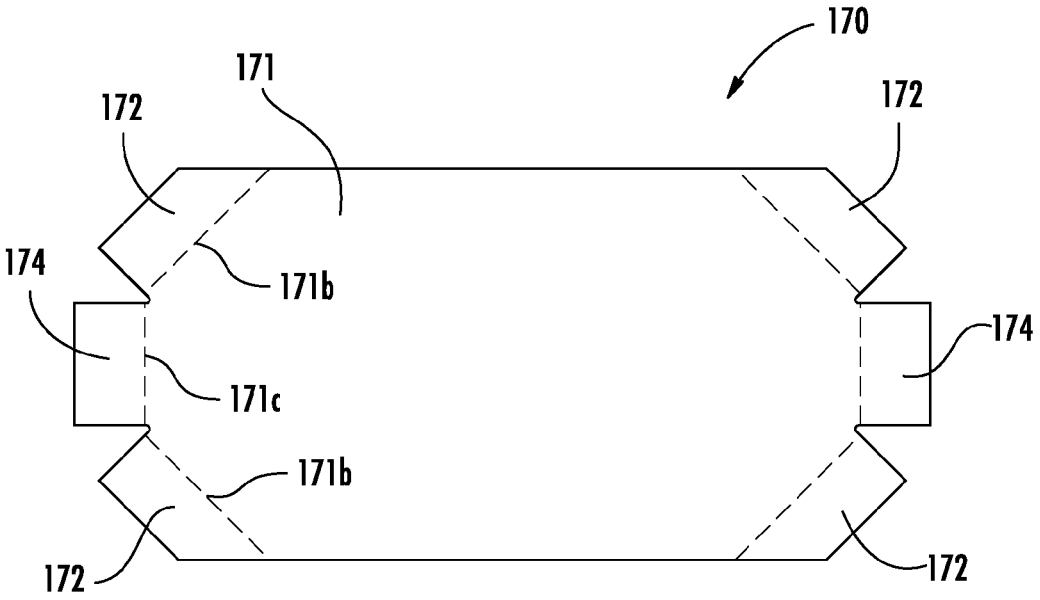
FIG. 11 is a top plan view of a horizontal pad according to an exemplary embodiment.

As shown in FIG. 11, according to an exemplary embodiment, the horizontal pad 170 is configured to be inserted into the packaging box to be positioned above and/or below the contents of the packaging box 100. For example, when used as a bottom pad, the horizontal pad 170 may provide reinforcement to a packaging box 100 underneath a plumbing fixture placed within the packaging box 100. When used as a top pad, the horizontal pad 170 may provide reinforcement to a packaging box 100 above a plumbing fixture placed within the packaging box 100. Thus, the horizontal pad 170 may create reinforcement via double padding a points of contact with contents of packaging, such as the toilet 150. In addition, the horizontal pad 170 may help to maintain the shape of a packaging box 100.

According to an exemplary embodiment, the horizontal pad 170 may have various corners and ends, and such corners and ends may correspond to the number of faces of the packaging box 100 or can be fewer in number than the faces of the packaging box 100. For example, FIG. 11 shows an exemplary embodiment of the horizontal pad 170, which generally includes a generally planar portion or panel 171 and one or more foldable corners 172 and ends 174 (e.g., flaps or panels) that correspond to the corner faces 119 and end faces 118 of a packaging box 100, respectively. For example, at a first and/or second end of the horizontal pad 170, one or more corner flaps 172 are connected to the panel 171 at a fold line or crease 171*b*, and an end flap 174 is connected to the panel 171 at a fold line or crease 171*c*.

The horizontal pad 170 is configured to be inserted into the cavity 180 of the packaging box 100, such that the panel 171 is arranged parallel to and/or positioned adjacent to or in contact with the bottom 111 or top 110 of the packaging box 100 (e.g., top panels 111*a*, 111*b* and/or flaps 112, 114), and such that foldable corners 172 and ends 174 can abut the corner faces 119 and end faces 118. For example, the foldable corners 172 and ends 174 fold upwards at crease or fold lines 171*b*, 171*c* (when used as a bottom pad) or downwards (when used as a top pad), so as to be generally parallel with and/or in contact with one of the corner panels 119*a*, 119*b* or the end panel 118, respectively, of the packaging box 100. The foldable corners 172 and ends 174 can be folded by a user before insertion of the horizontal pad 170 into the packaging box 100 or they can be folded during insertion of the horizontal pad 170 by pressing the horizontal pad 170 into the interior of the packaging box 100. The corners 172 and ends 174 of a horizontal pad 170 can have the shapes shown in the example of FIG. 11 or can have various other suitable shapes. According to the exemplary embodiment shown in FIG. 63, the horizontal pad may include a single flap 274 at a rear portion thereof.

According to an exemplary embodiment, the horizontal pad 170 is formed from a continuous sheet of material (e.g., cardboard, plastic, corrugated materials, etc.) with the panels and flaps 171, 172, 174 being defined by folds or creases in the sheet of material.

According to various exemplary embodiments, the packaging box 100 can be assembled with one or more horizontal pads 170, one or more end pads 160 and one or more horizontal pads 170, either of the end pads 160 and the horizontal pads 170, or neither of the end pads 160 and the horizontal pads 170.

According to an exemplary embodiment, a packaged plumbing fixture is provided by packaging a plumbing fixture, such as a toilet, within a packaging box 100 to provide a combination of a packaging box and a plumbing fixture according to the embodiments described herein.

According to an exemplary embodiment, the packaging box 100 can have a reduced perimeter and less wasted space in comparison to conventional boxes, such as by providing a greater number of vertical corners 130 so that the perimeter of the box more closely conforms to the plumbing fixture placed within the box 100. As a result, the packaging box 100 can use less material, such as, for example, between approximately 10 and 15 percent less than conventional boxes, or even approximately 23 percent less than a conventional rectangular box.

According to an exemplary embodiment, the packaging box 100 provides an ergonomic design which is easier to lift and can be handled in a more natural position. Thus, the packaging box 100 can provide a more comfortable, ergonomic lifting position than a convention packaging. In addition, the narrower end and smaller profile of box means that box can be more likely to fit in end purchaser's car, such as in back seat or trunk.

The packaging box 100 can have a more narrow or tapering end due to the increased number of vertical corners, which permits a user to position his or her knees laterally to the end of the packaging box 100, such as to the sides of the end face or panel 118 of the packaging box 100, thus providing a more comfortable, ergonomic lifting position than with conventional packaging, which can prevent a user's knees from being positioned laterally on either side of an end face, due to the size of the single end face provided by a conventional rectangular box.

Figure 13:
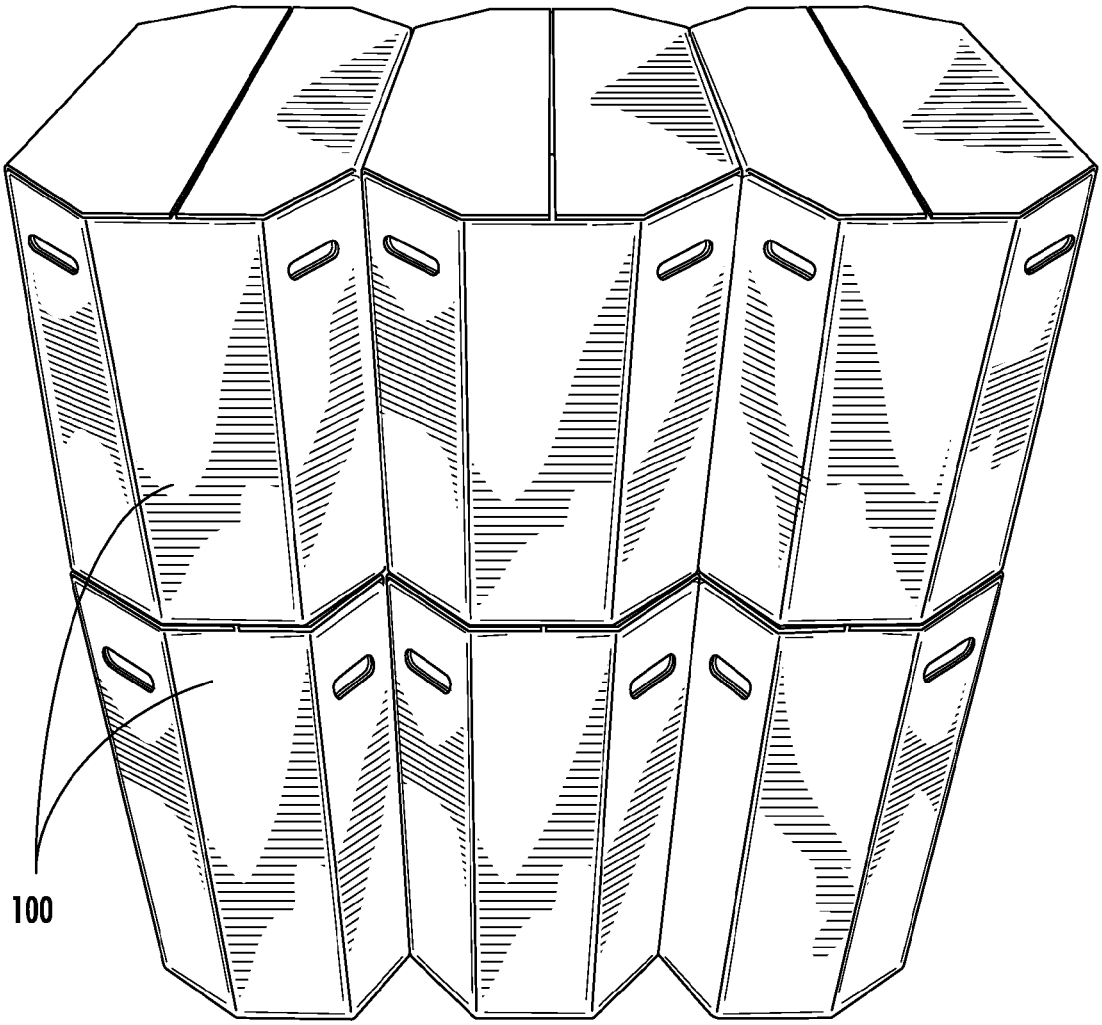
FIG. 13 is a top perspective view of a plurality of packaging boxes stacked upon one another according to an exemplary embodiment.
Figure 14:
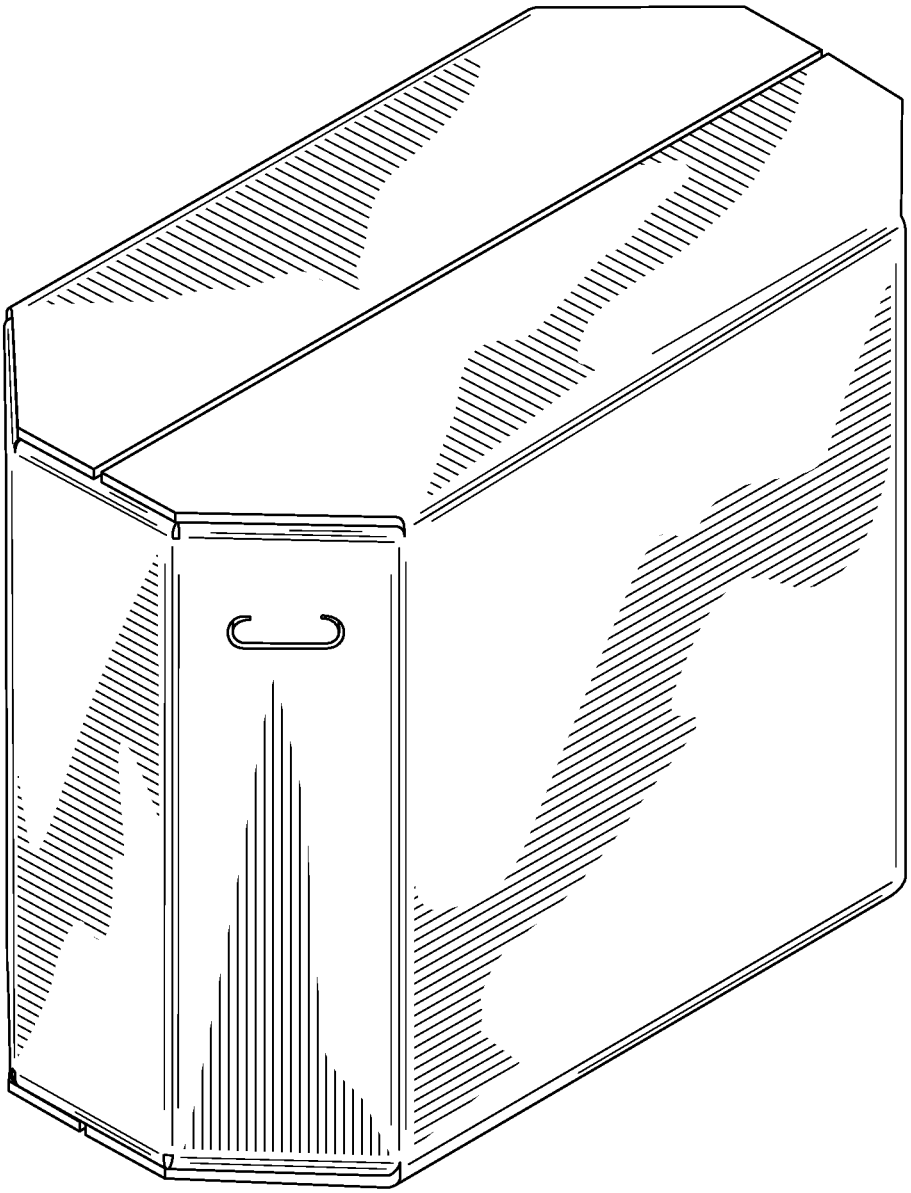
FIG. 14 is a top perspective view of a packaging box according to another exemplary embodiment.
Figure 15:
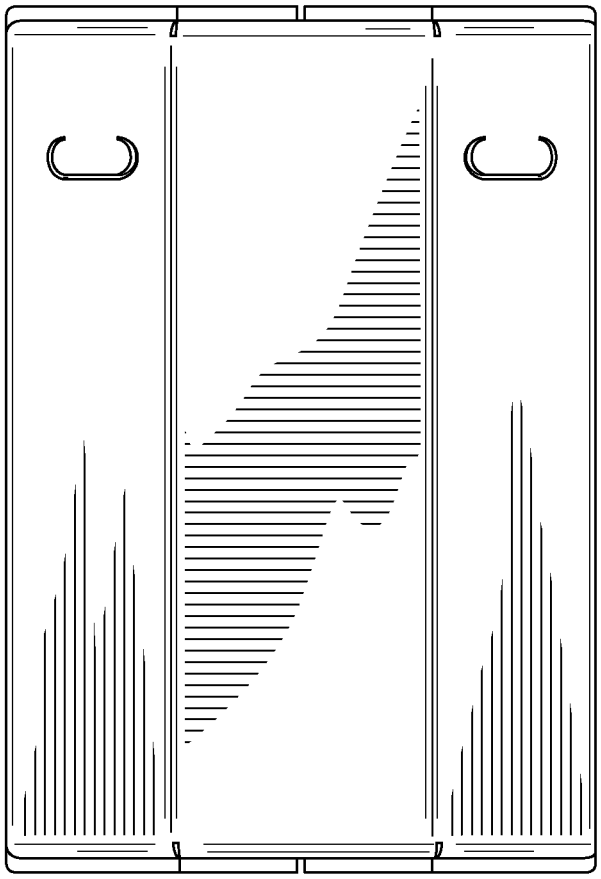
FIG. 15 is a front elevation view of the packaging box of FIG. 14.
Figure 16:
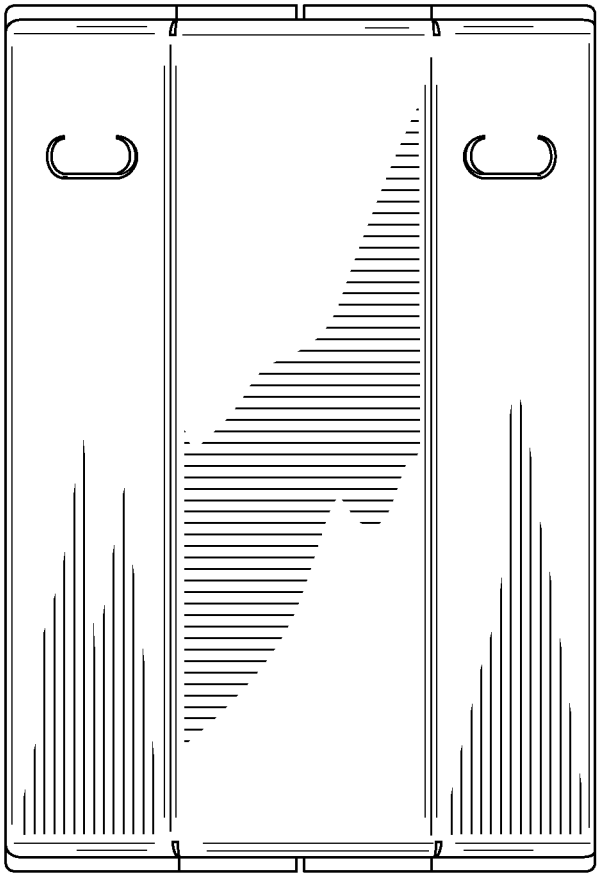
FIG. 16 is a rear elevation view of the packaging box of FIG. 14.
Figure 17:
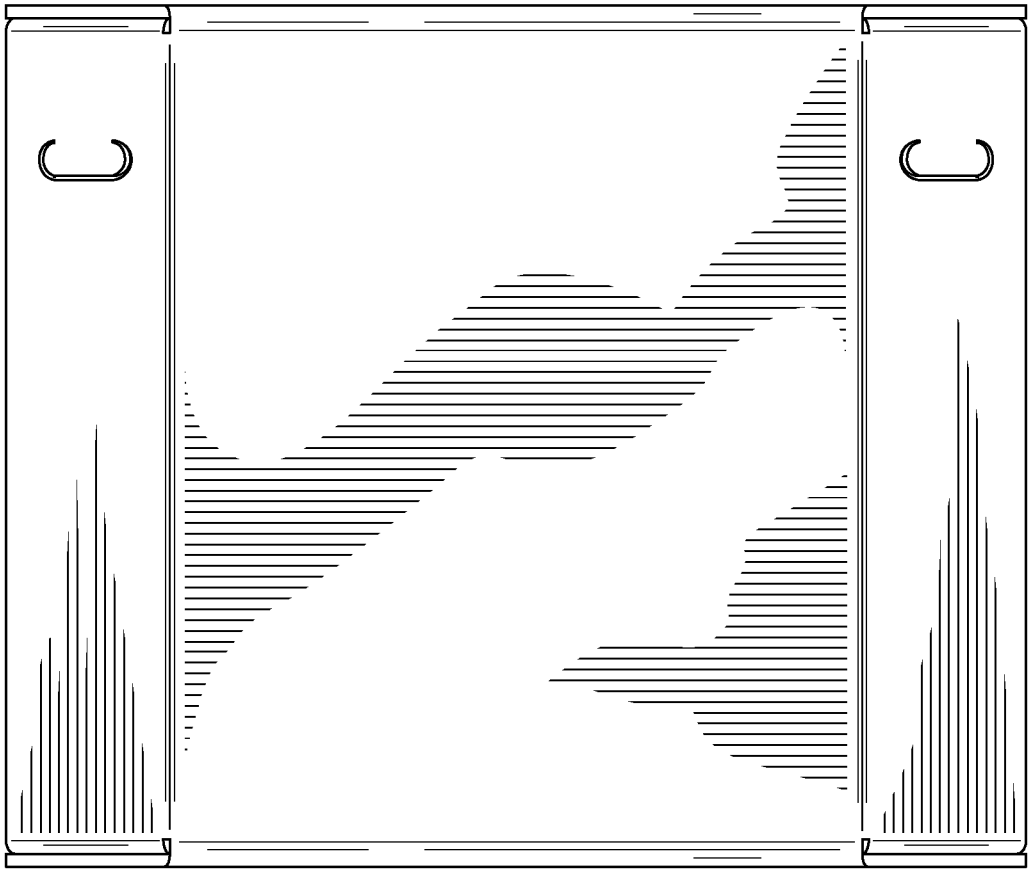
FIG. 17 is a right-side elevation view of the packaging box of FIG. 14.
Figure 18:
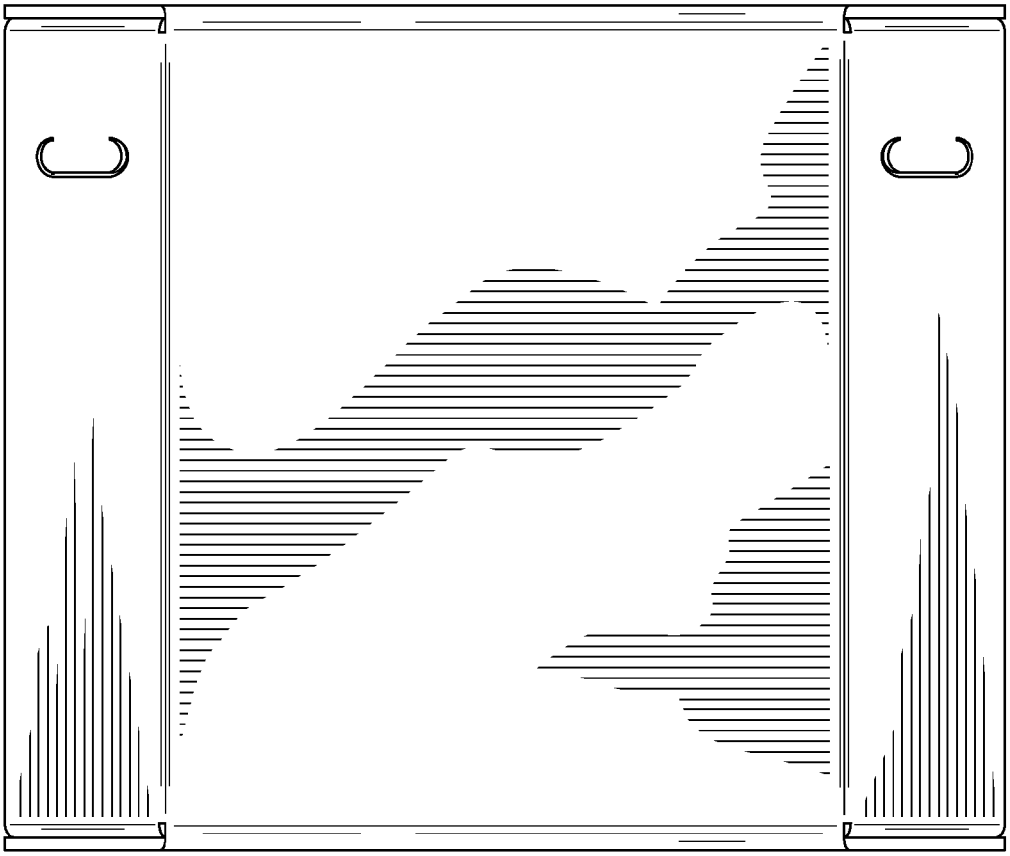
FIG. 18 is a left-side elevation view of the packaging box of FIG. 14.
Figure 19:
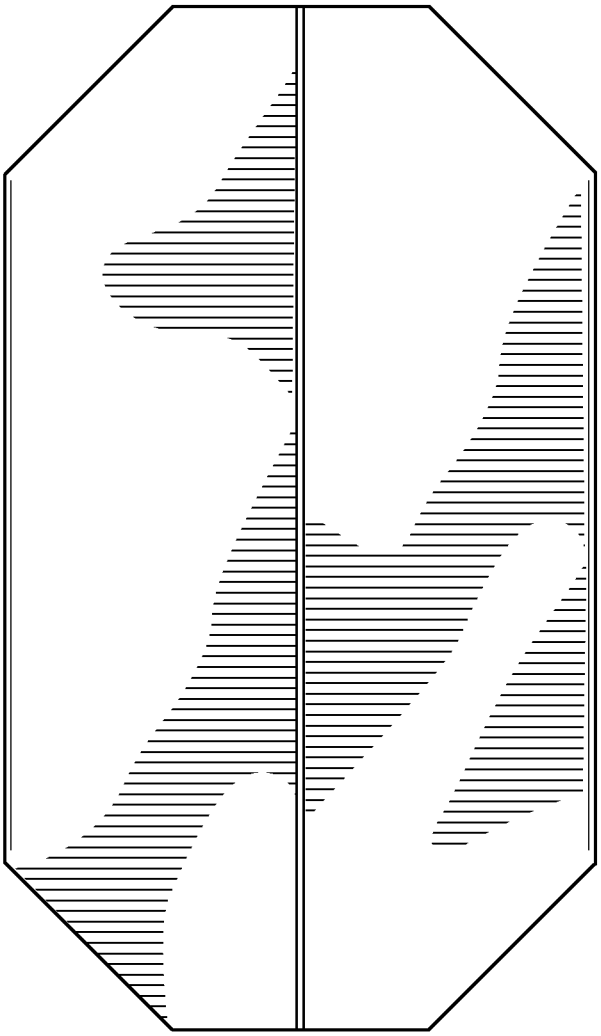
FIG. 19 is a top plan view of the packaging box of FIG. 14.
Figure 20:
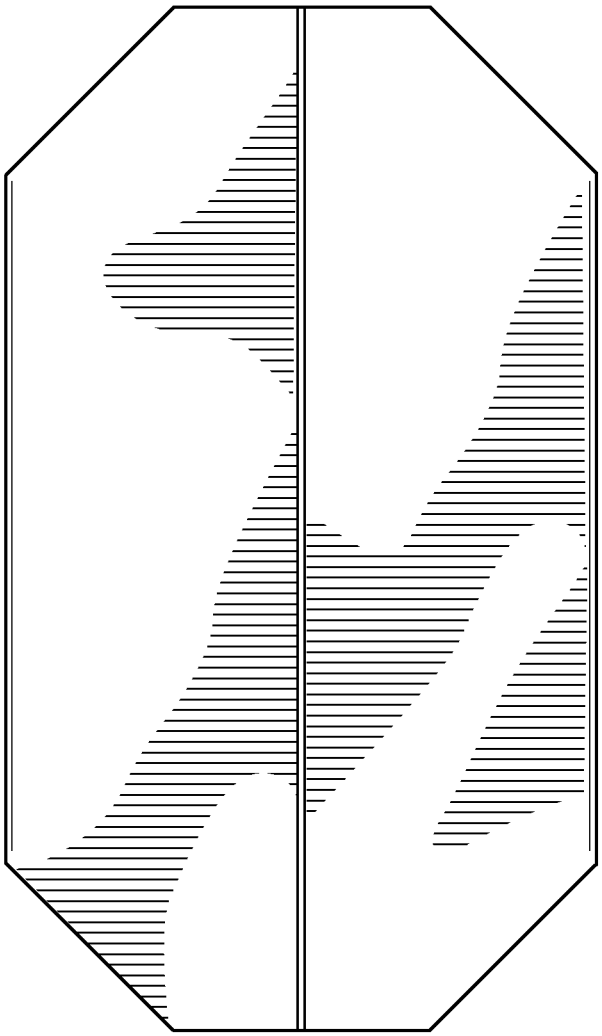
FIG. 20 is a bottom plan view of the packaging box of FIG. 14.
Figure 21:
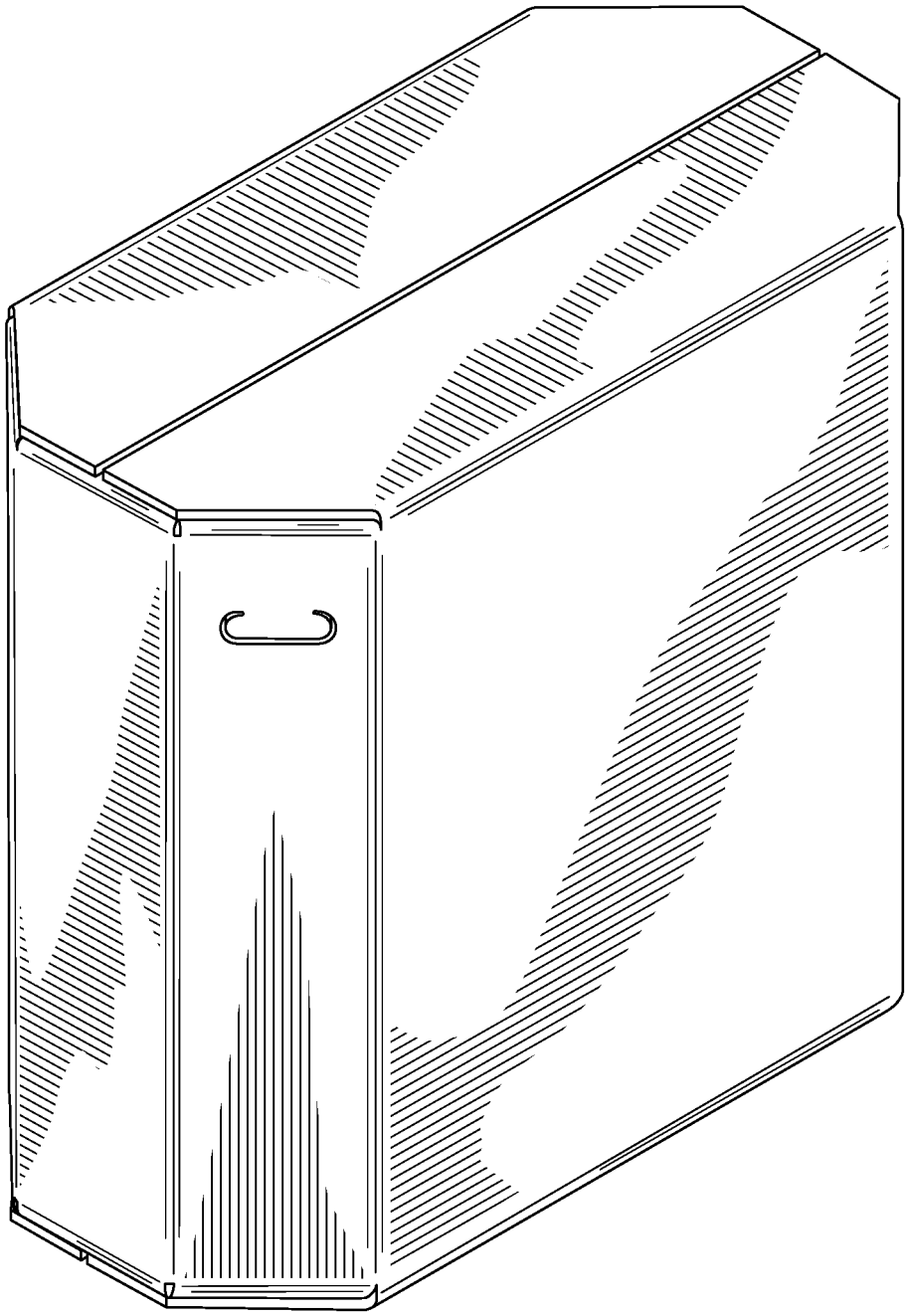
FIG. 21 is a top perspective view of a packaging box according to another exemplary embodiment.
Figure 22:
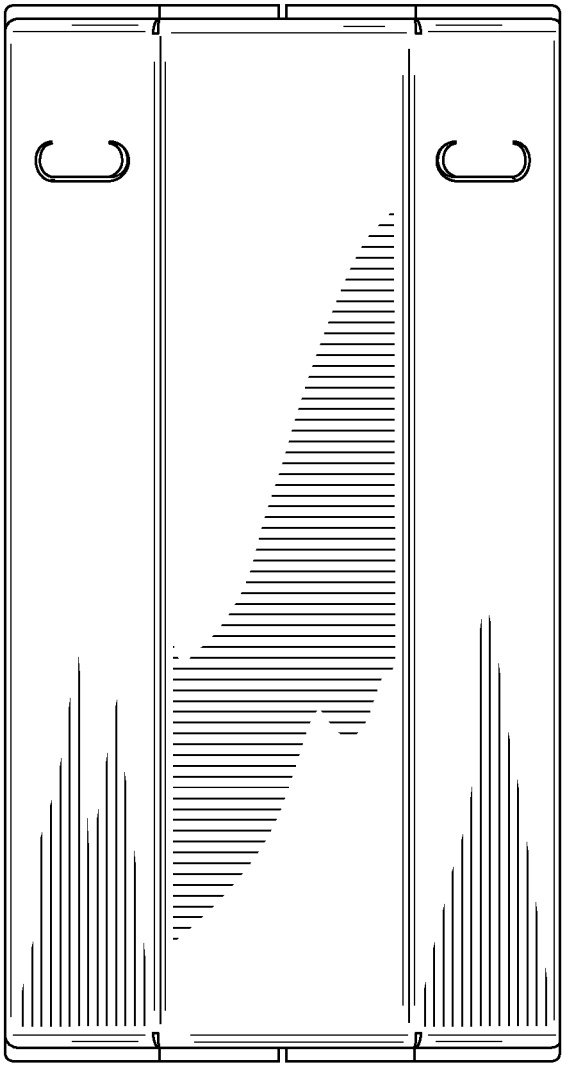
FIG. 22 is a front elevation view of the packaging box of FIG. 21.
Figure 23:
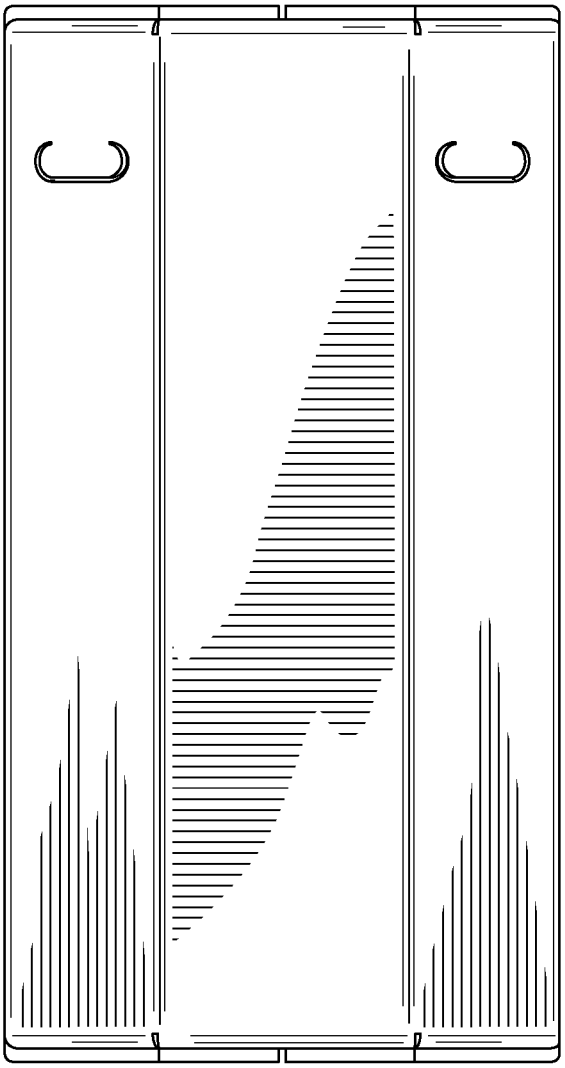
FIG. 23 is a rear elevation view of the packaging box of FIG. 21.
Figure 24:
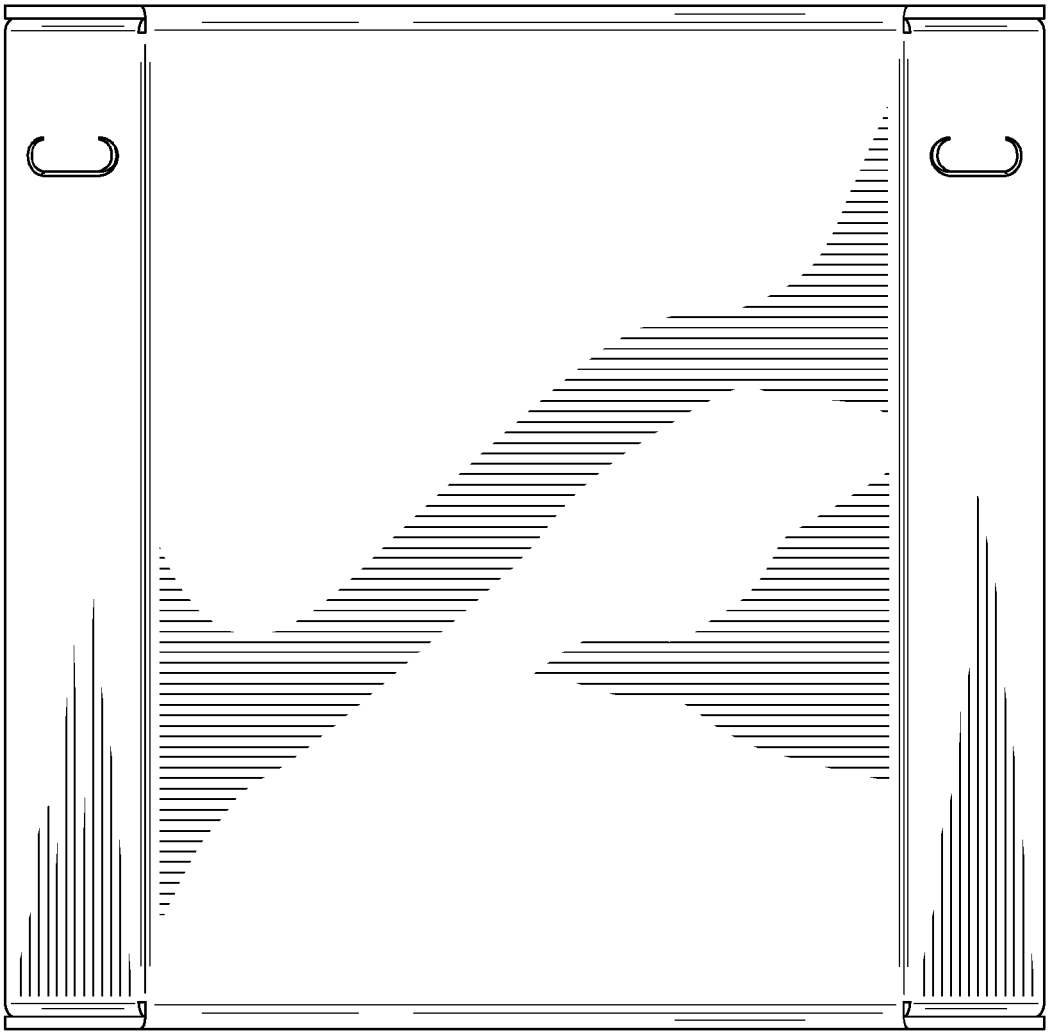
FIG. 24 is a right-side elevation view of the packaging box of FIG. 21.
Figure 25:
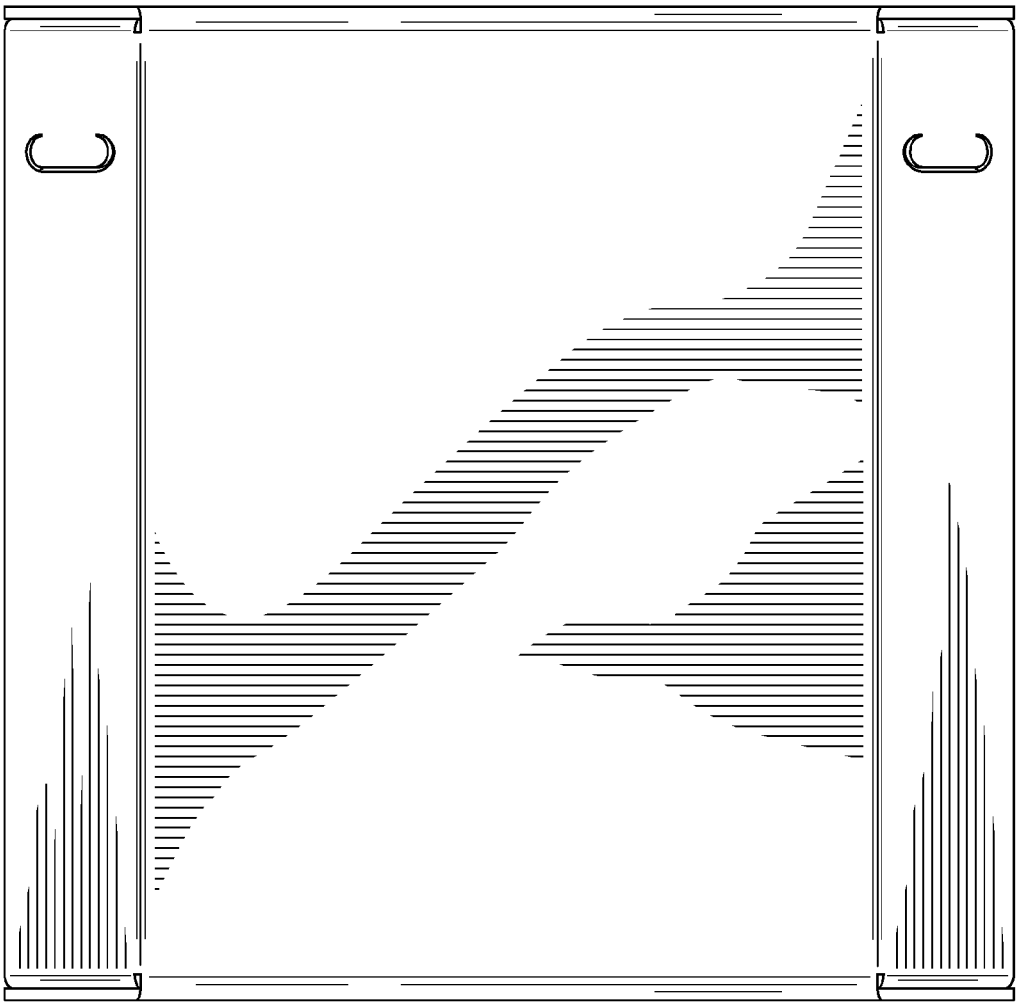
FIG. 25 is a left-side elevation view of the packaging box of FIG. 21.
Figure 26:
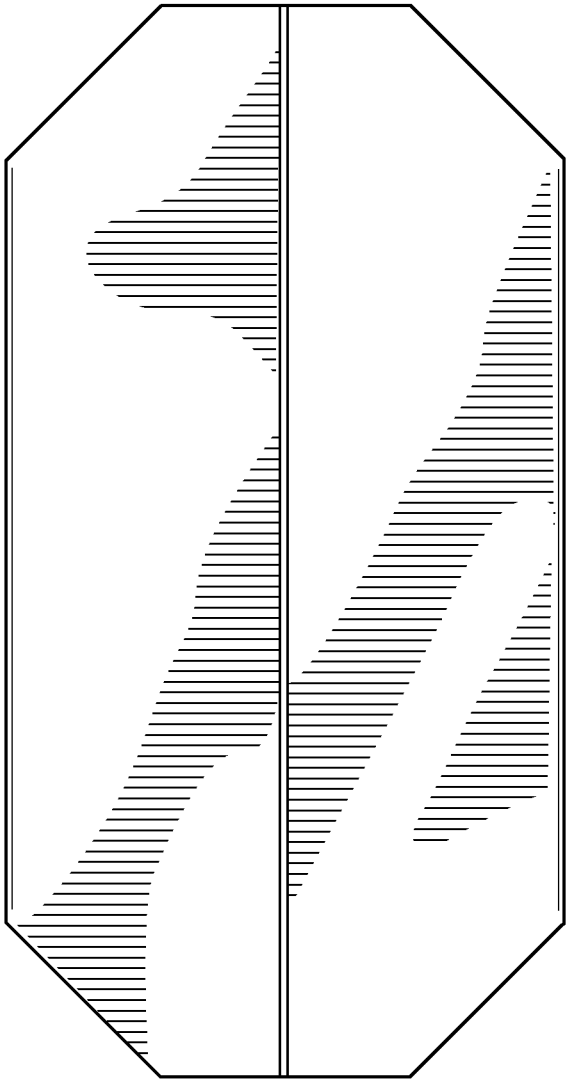
FIG. 26 is a top plan view of the packaging box of FIG. 21.
Figure 27:
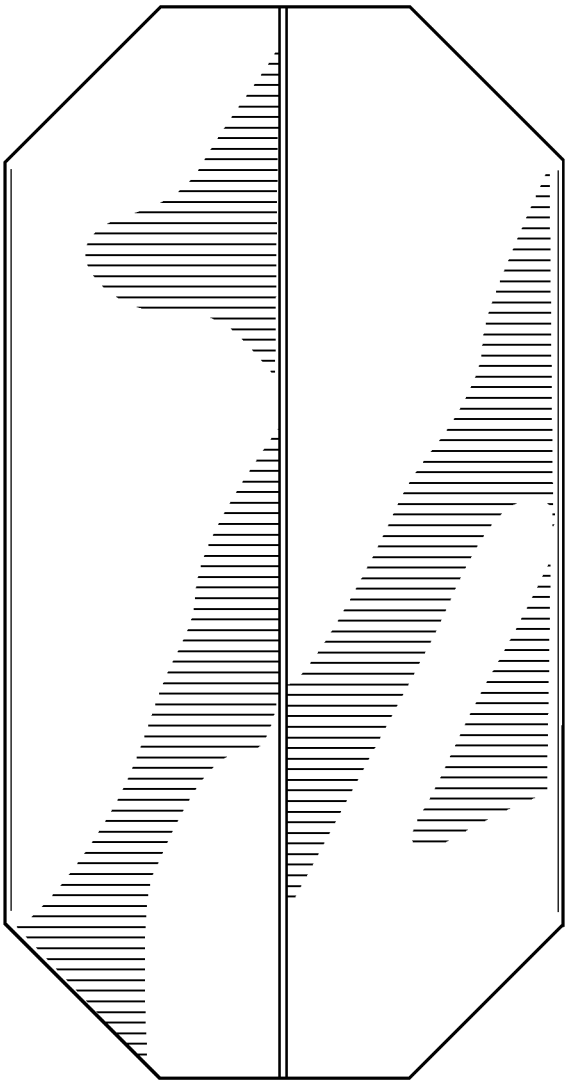
FIG. 27 is a bottom plan view of the packaging box of FIG. 21.
Figure 28:
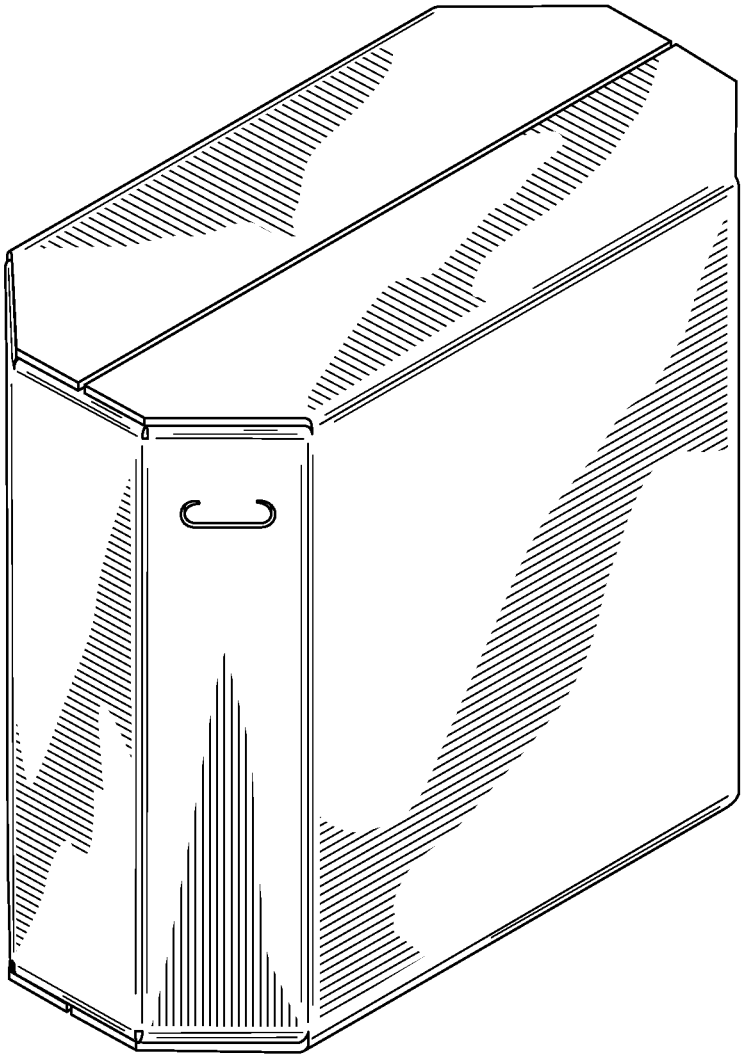
FIG. 28 is a top perspective view of a packaging box according to another exemplary embodiment.
Figure 29:
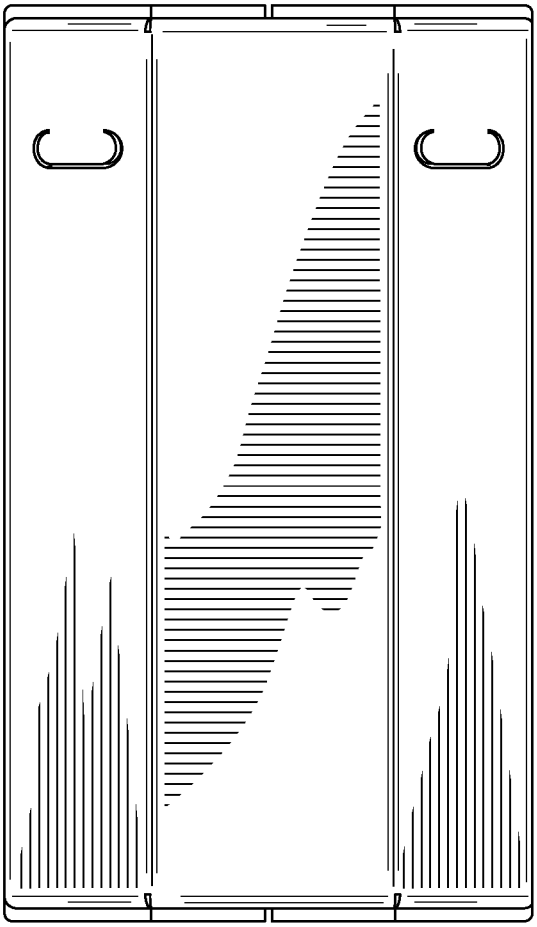
FIG. 29 is a front elevation view of the packaging box of FIG. 28.
Figure 30:
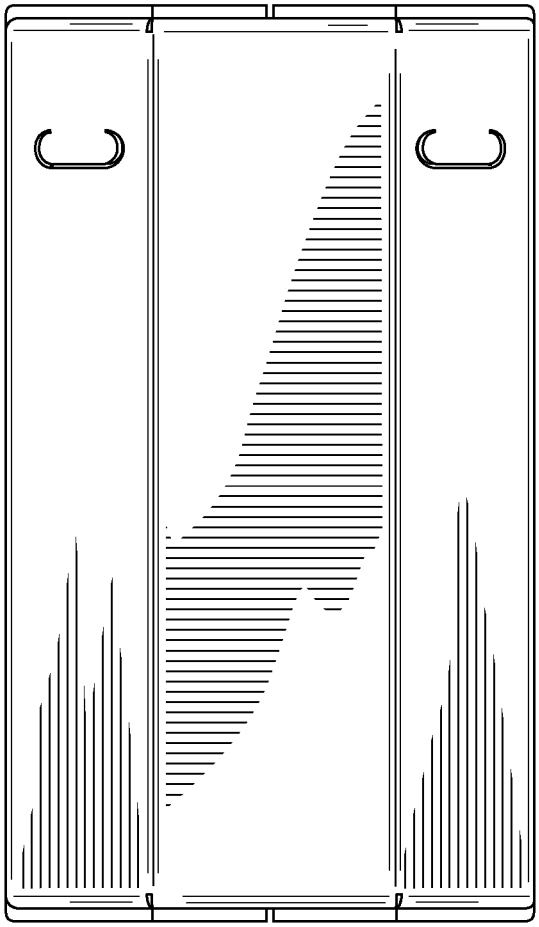
FIG. 30 is a rear elevation view of the packaging box of FIG. 28.
Figure 31:
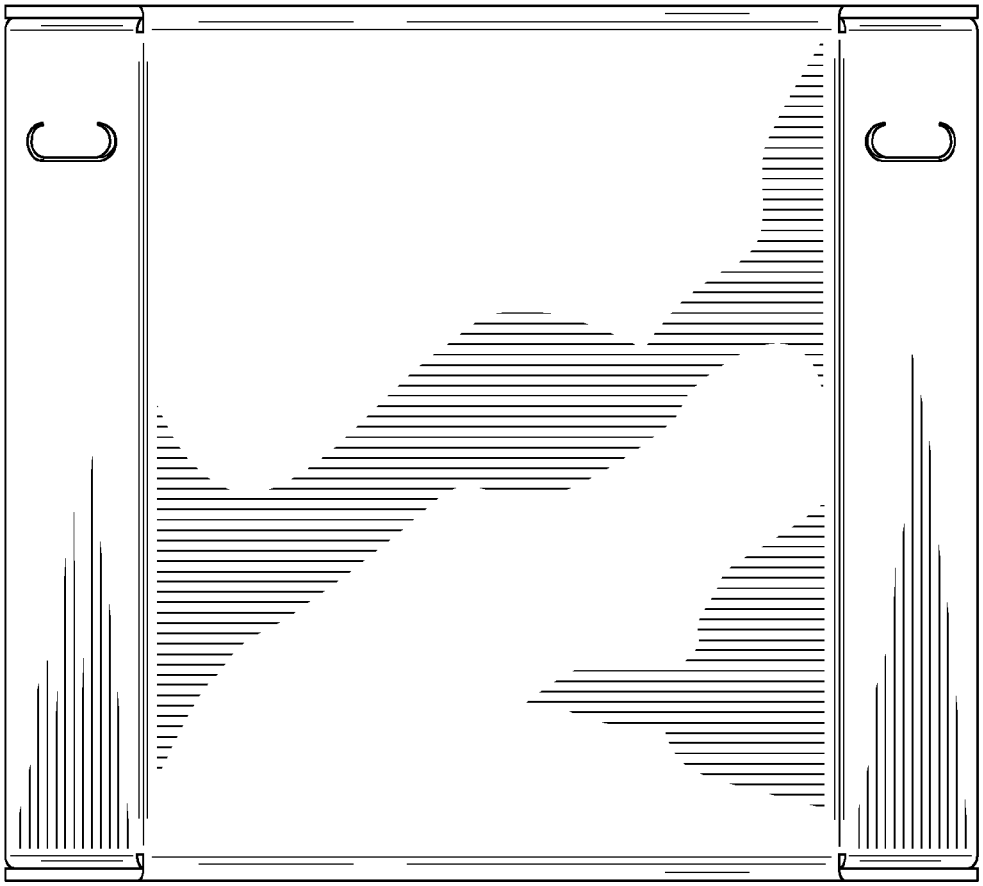
FIG. 31 is a right-side elevation view of the packaging box of FIG. 28.
Figure 32:
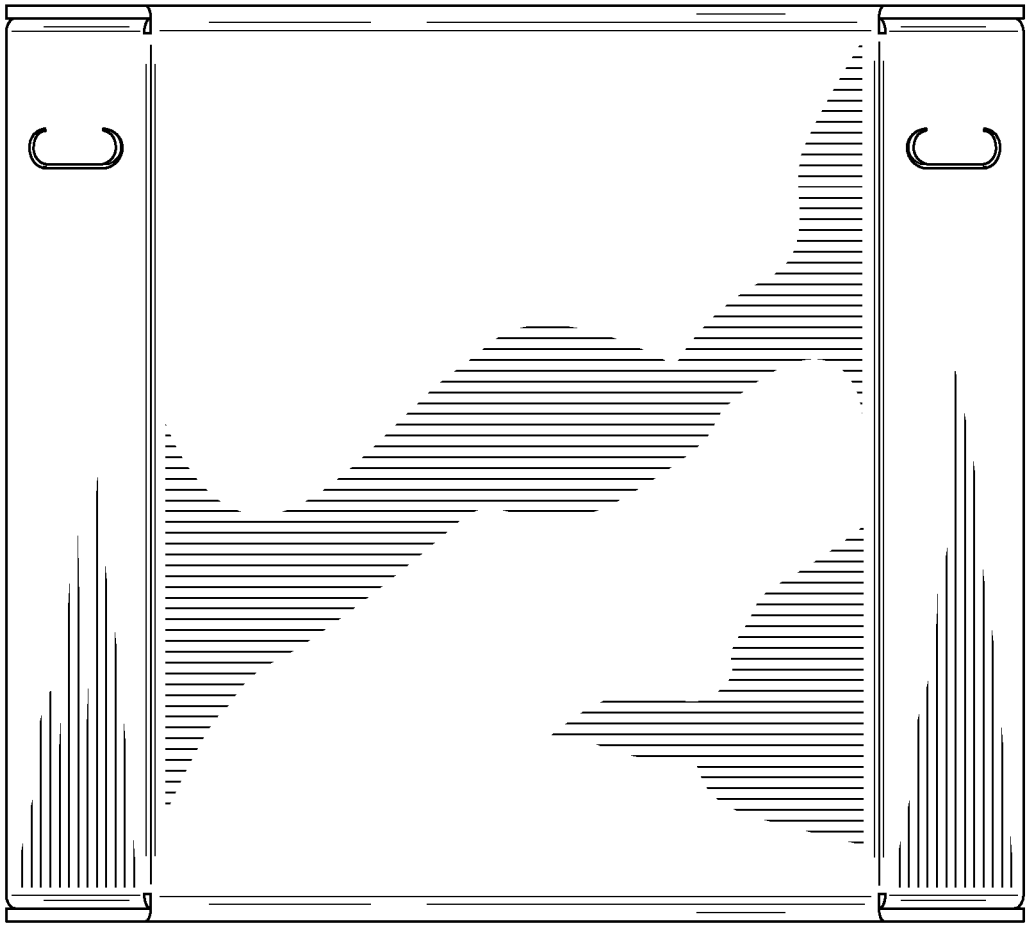
FIG. 32 is a left-side elevation view of the packaging box of FIG. 28.
Figure 33:
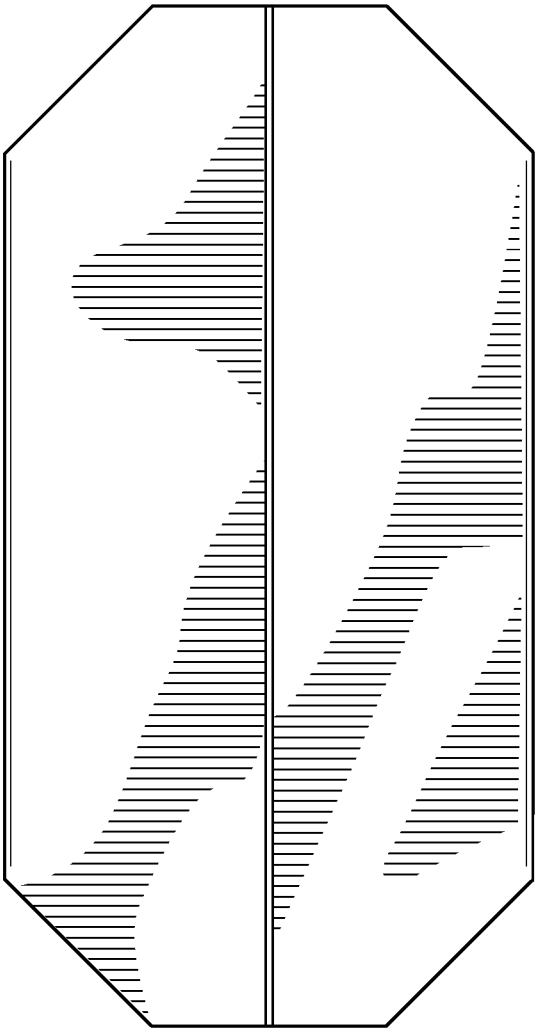
FIG. 33 is a top plan view of the packaging box of FIG. 28.
Figure 34:
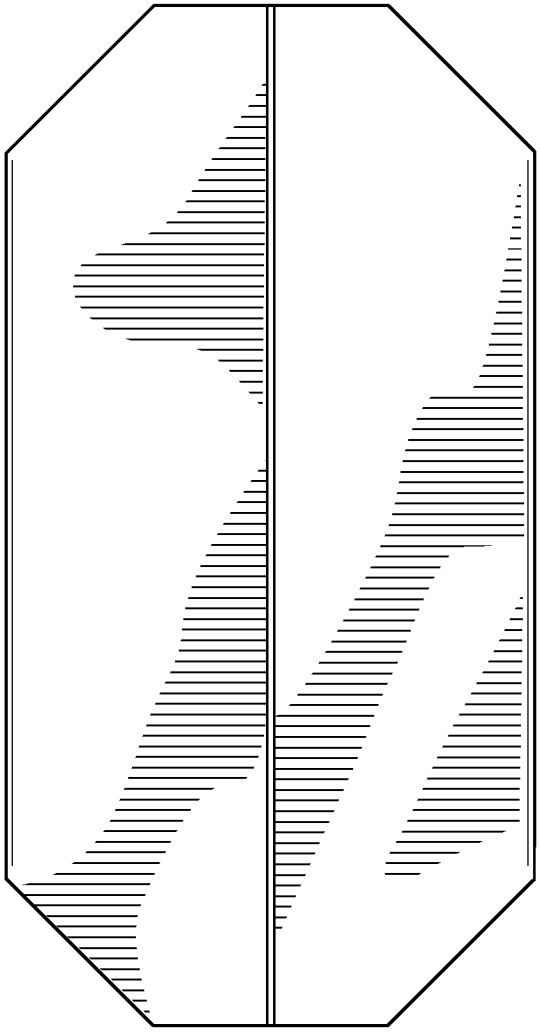
FIG. 34 is a bottom plan view of the packaging box of FIG. 28.
Figure 35:
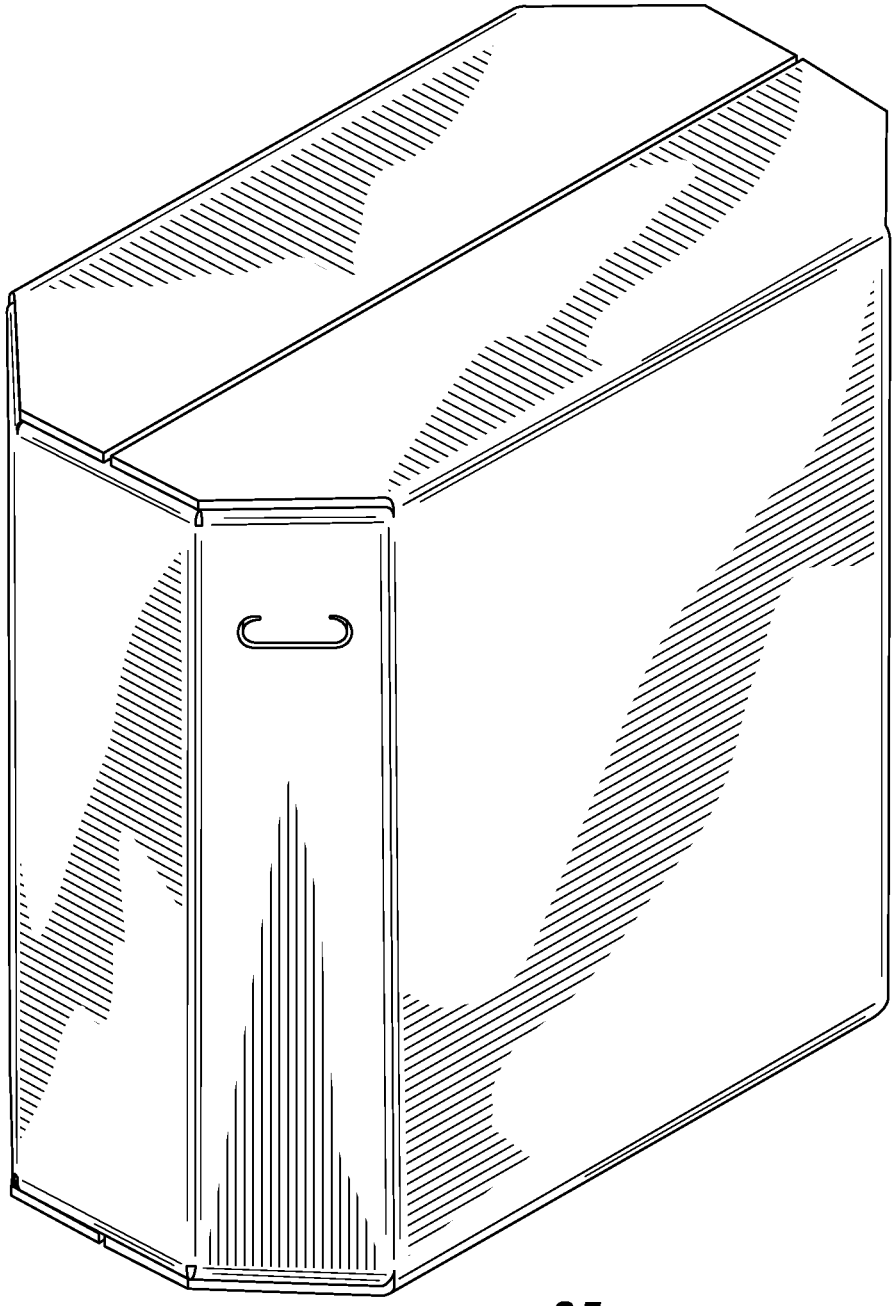
FIG. 35 is a top perspective view of a packaging box according to another exemplary embodiment.
Figure 36:
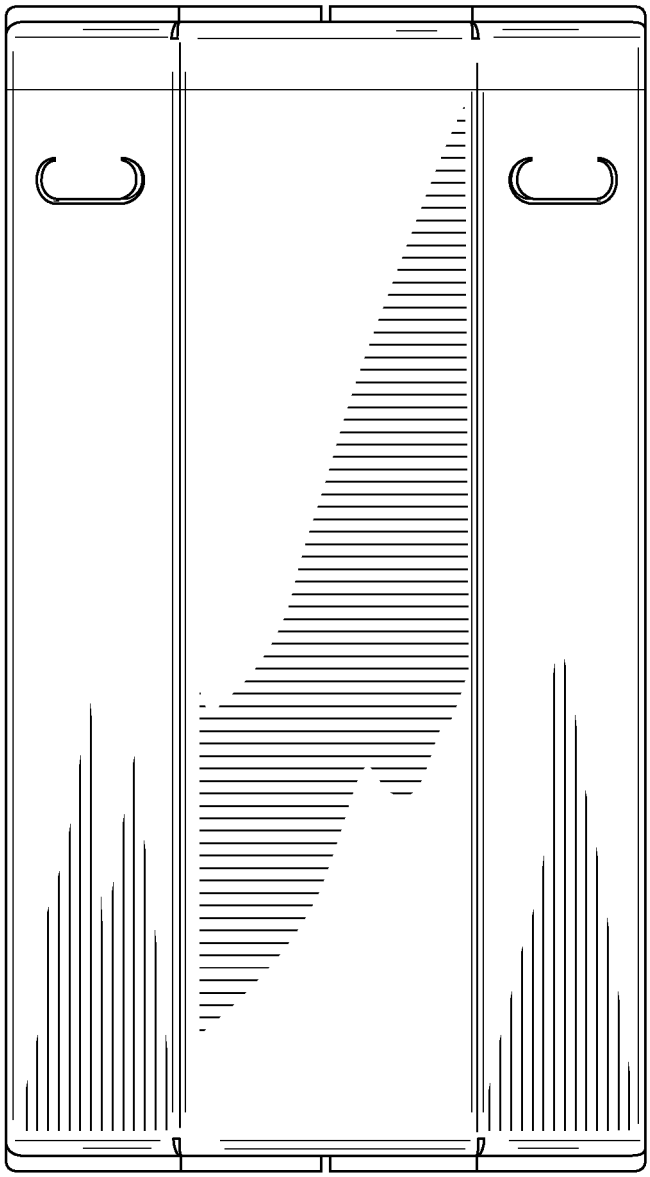
FIG. 36 is a front elevation view of the packaging box of FIG. 35.
Figure 37:
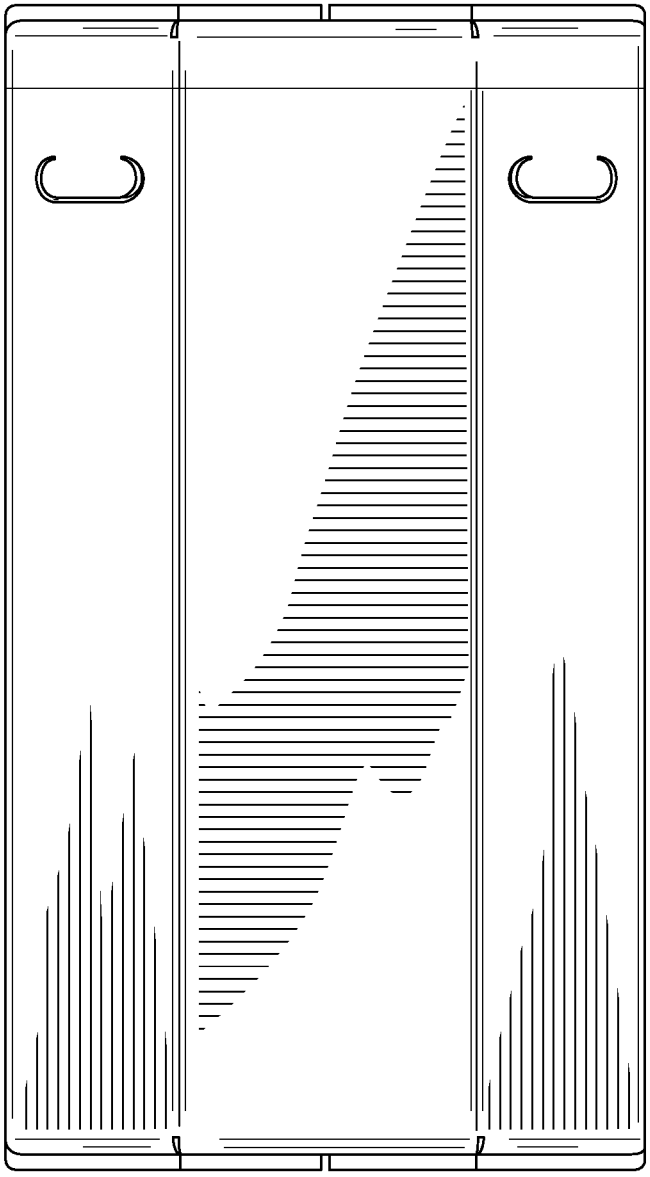
FIG. 37 is a rear elevation view of the packaging box of FIG. 35.
Figure 38:
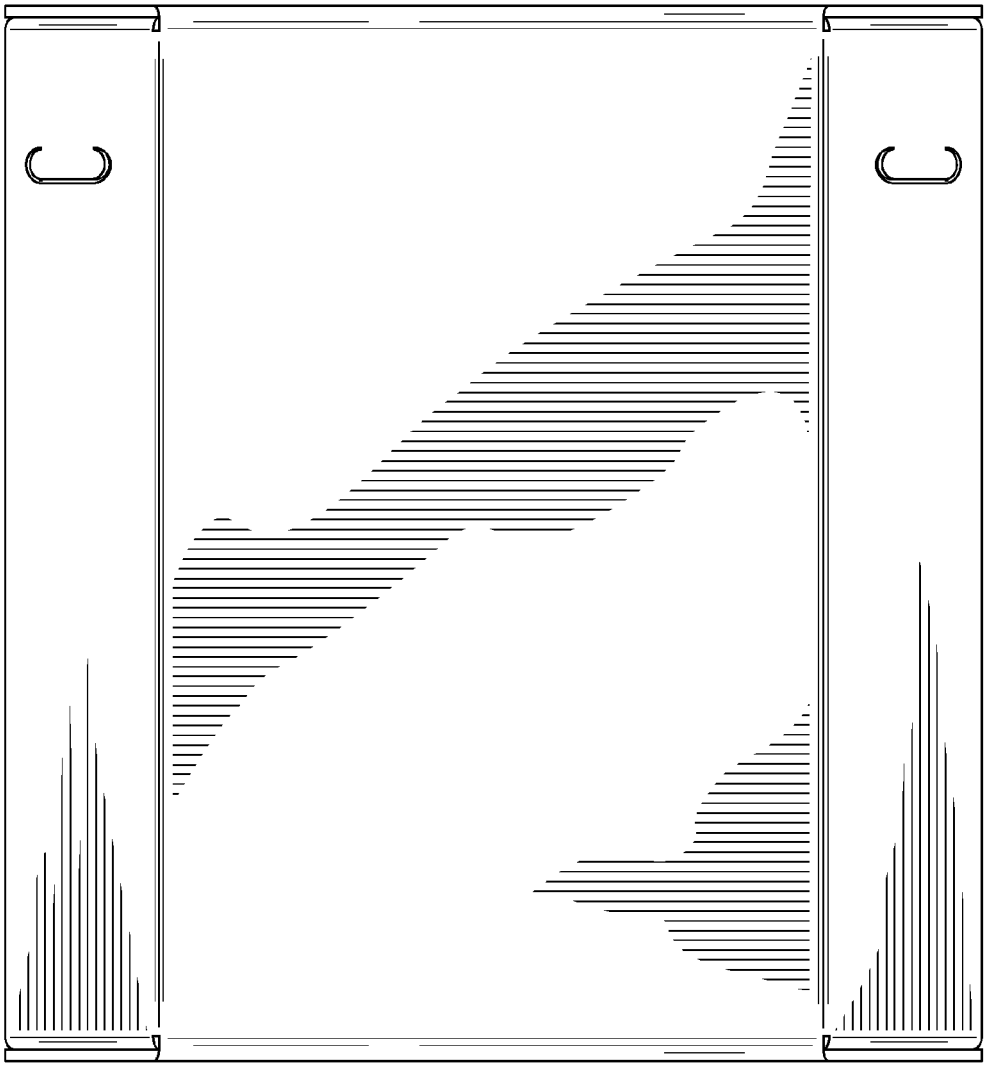
FIG. 38 is a right-side elevation view of the packaging box of FIG. 35.
Figure 39:
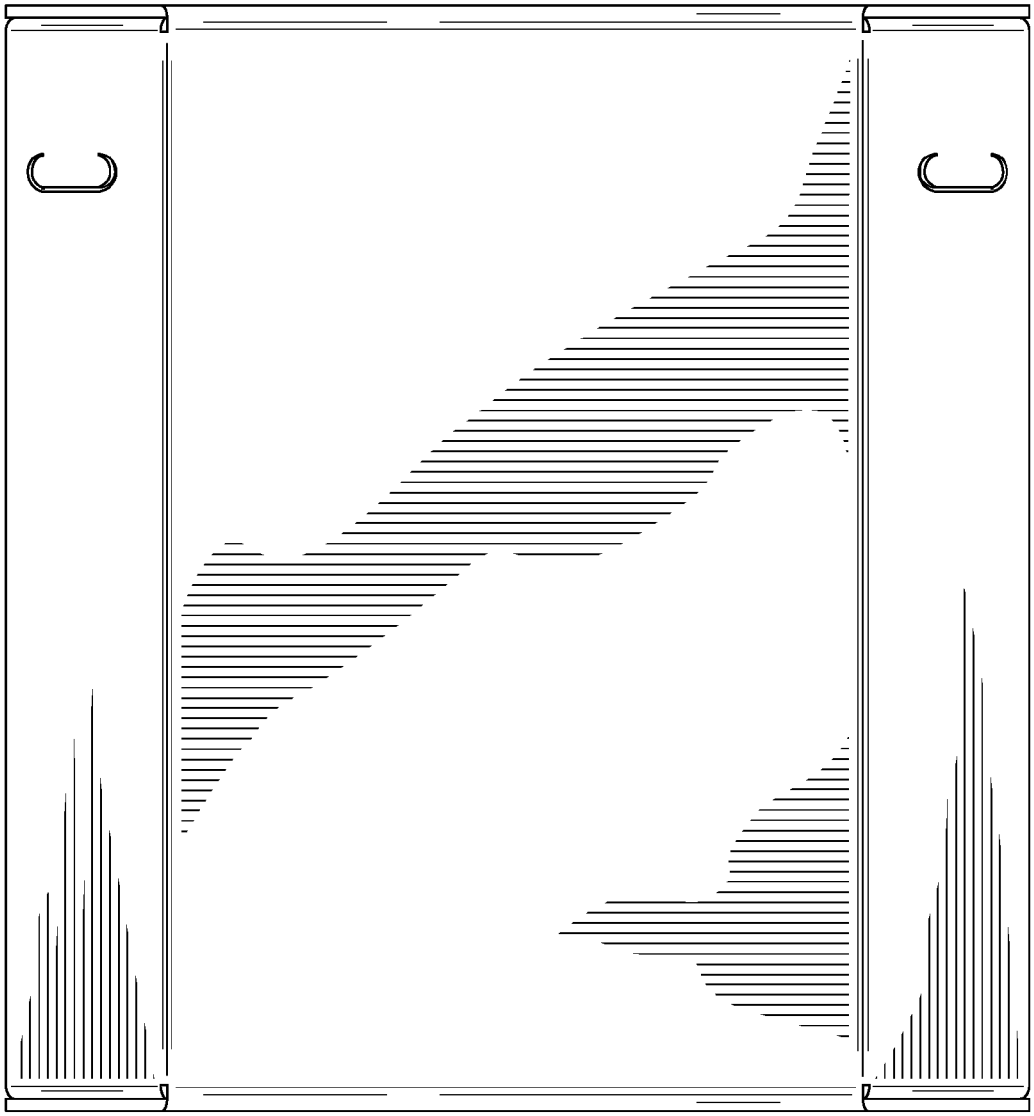
FIG. 39 is a left-side elevation view of the packaging box of FIG. 35.
Figure 40:
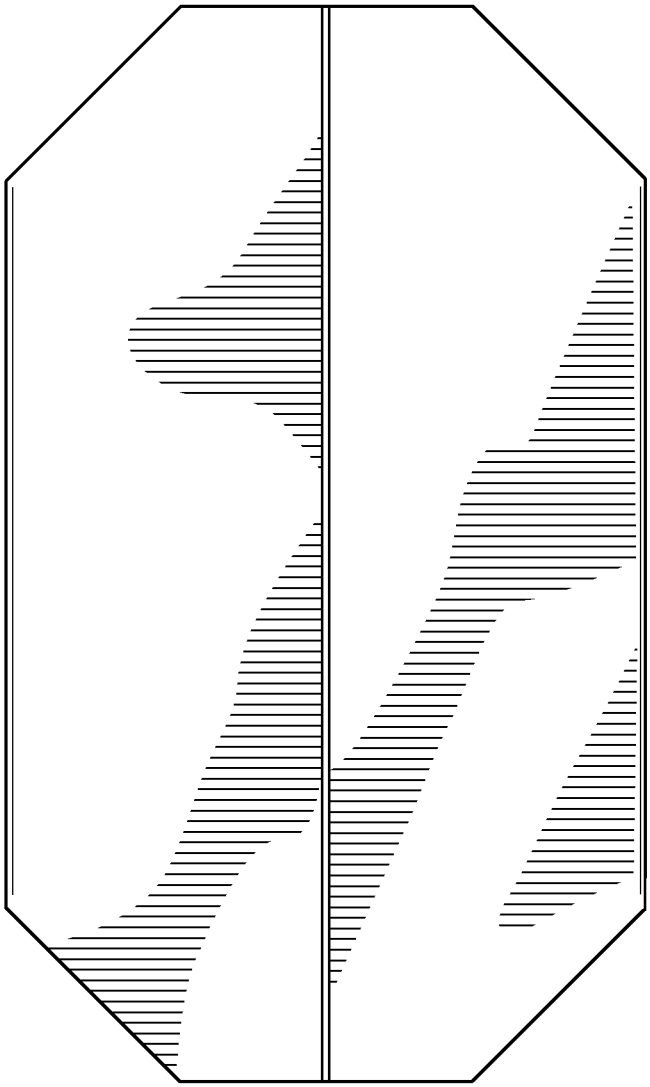
FIG. 40 is a top plan view of the packaging box of FIG. 35.
Figure 41:
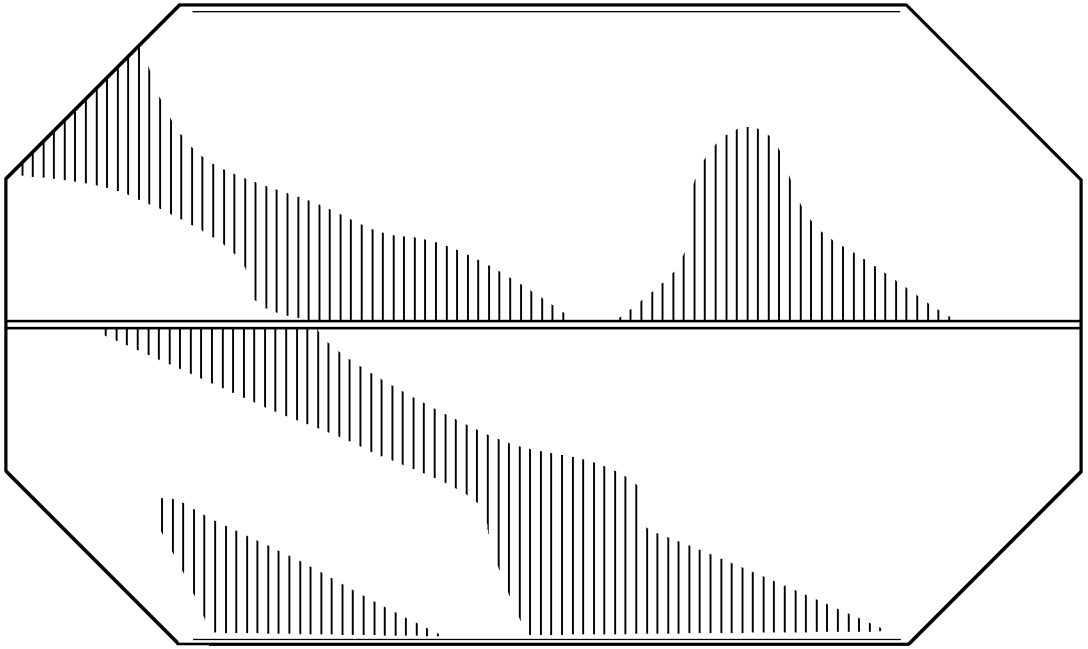
FIG. 41 is a bottom plan view of the packaging box of FIG. 35.
Figure 42:
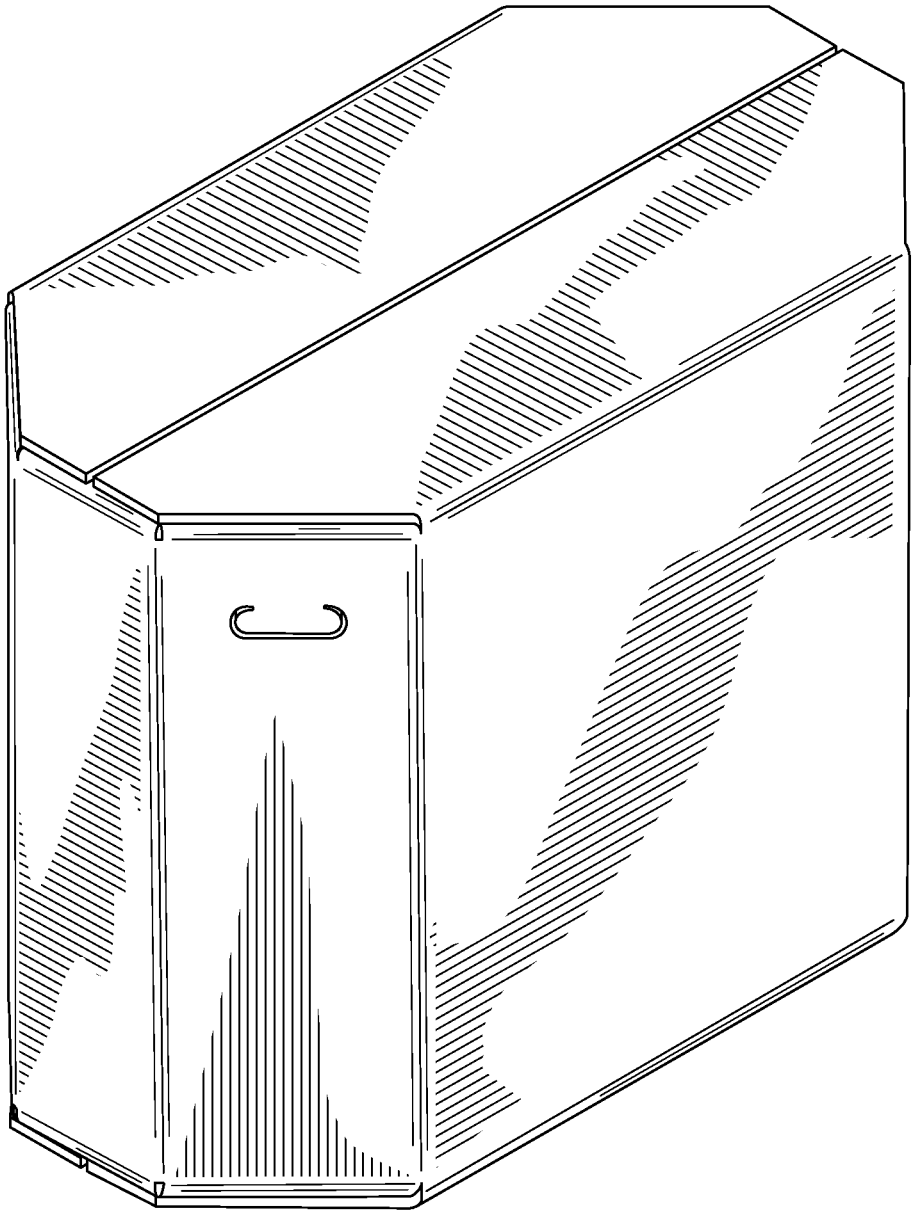
FIG. 42 is a top perspective view of a packaging box according to another exemplary embodiment.
Figure 43:
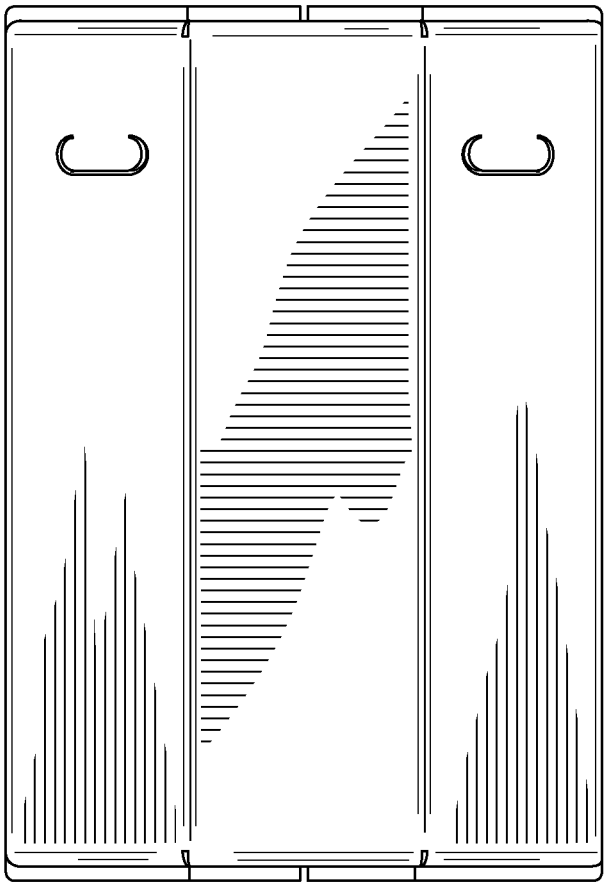
FIG. 43 is a front elevation view of the packaging box of FIG. 42.
Figure 44:
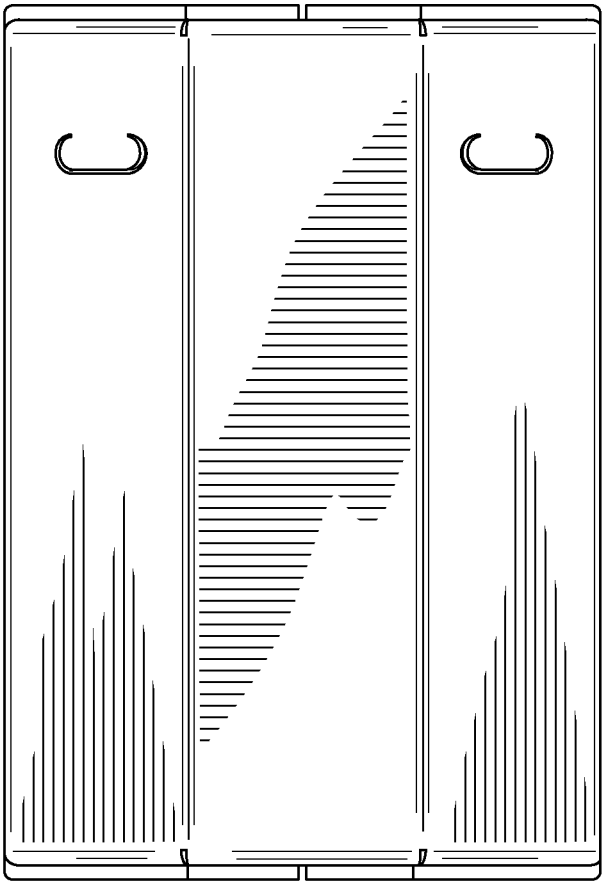
FIG. 44 is a rear elevation view of the packaging box of FIG. 42.
Figure 45:
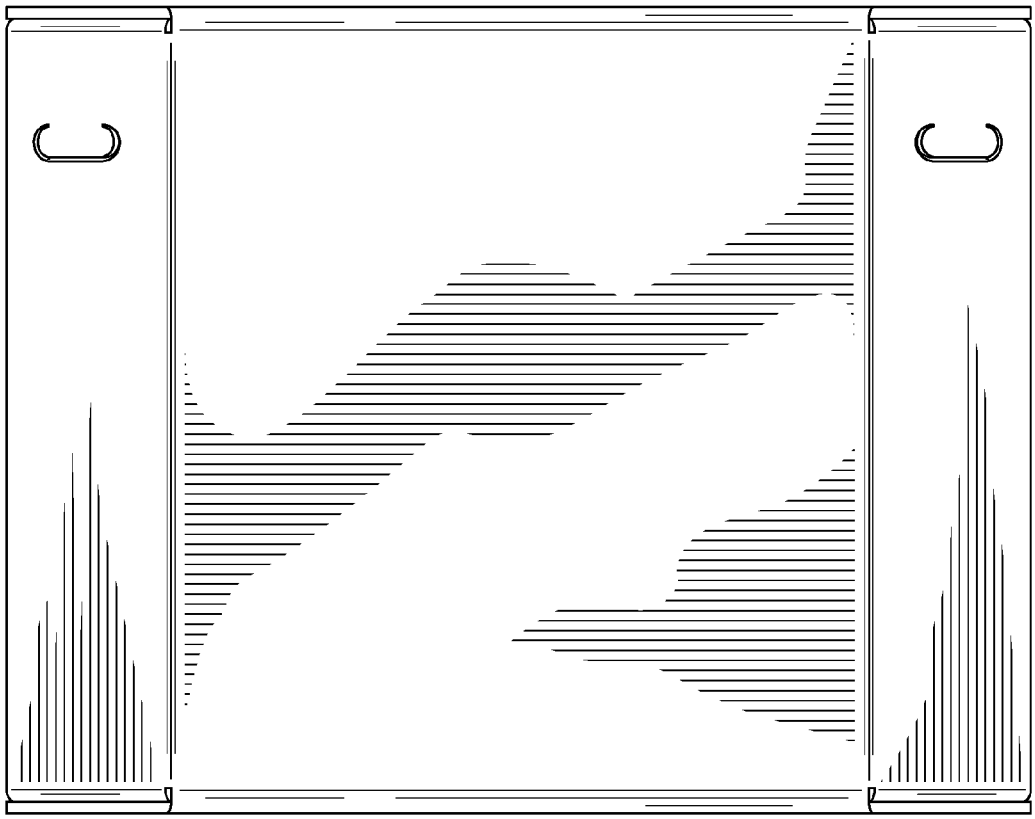
FIG. 45 is a right-side elevation view of the packaging box of FIG. 42.
Figure 46:
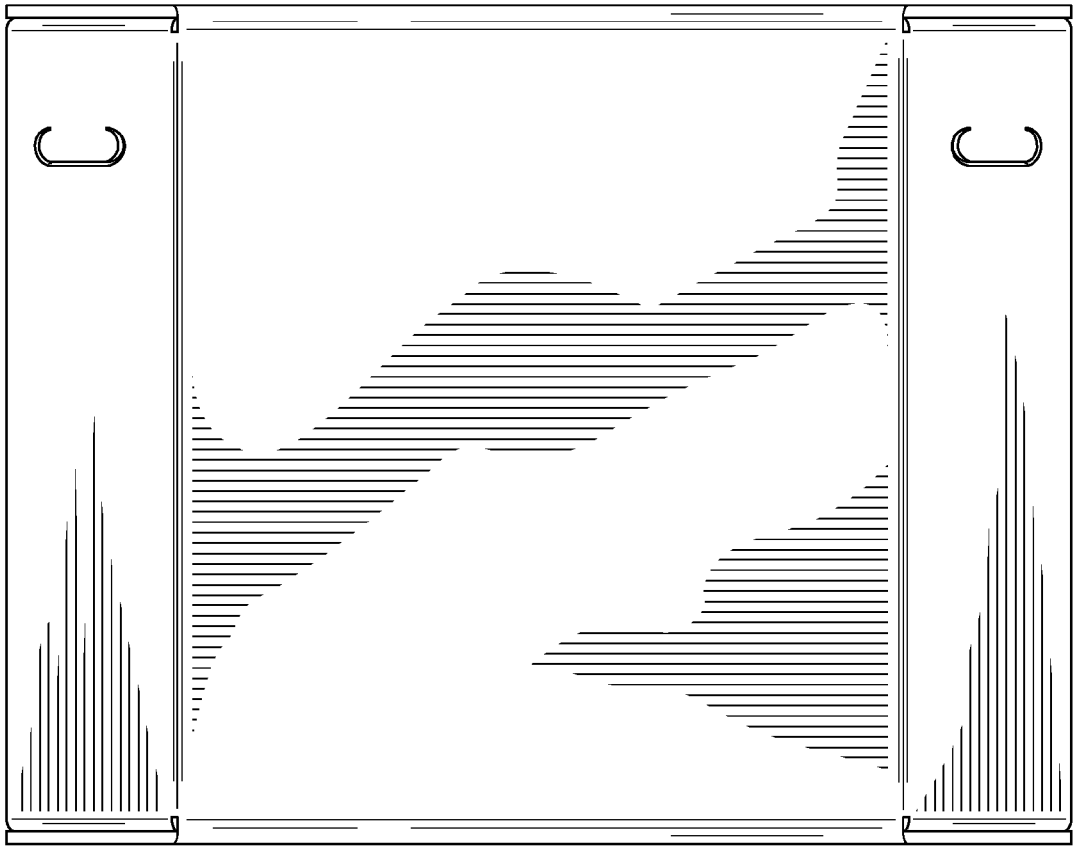
FIG. 46 is a left-side elevation view of the packaging box of FIG. 42.
Figure 47:
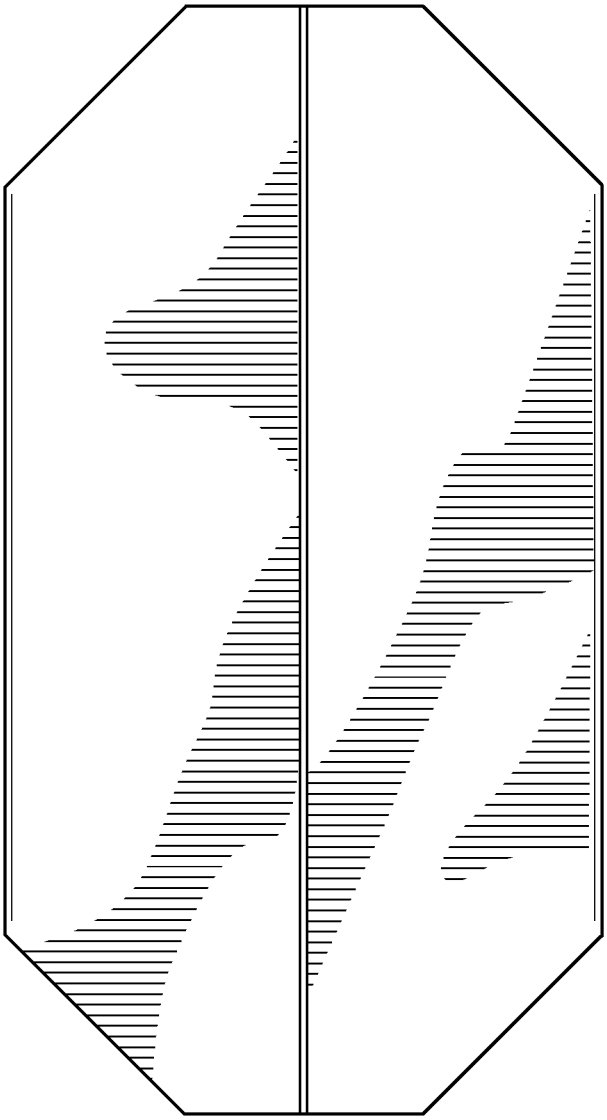
FIG. 47 is a top plan view of the packaging box of FIG. 42.
Figure 48:
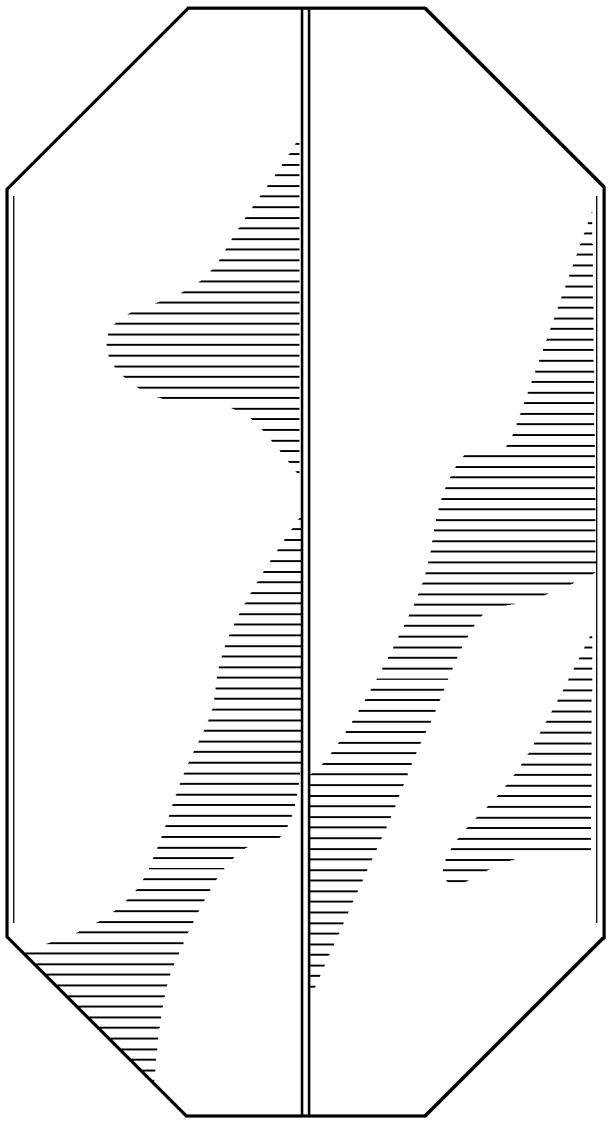
FIG. 48 is a bottom plan view of the packaging box of FIG. 42.
Figure 49:
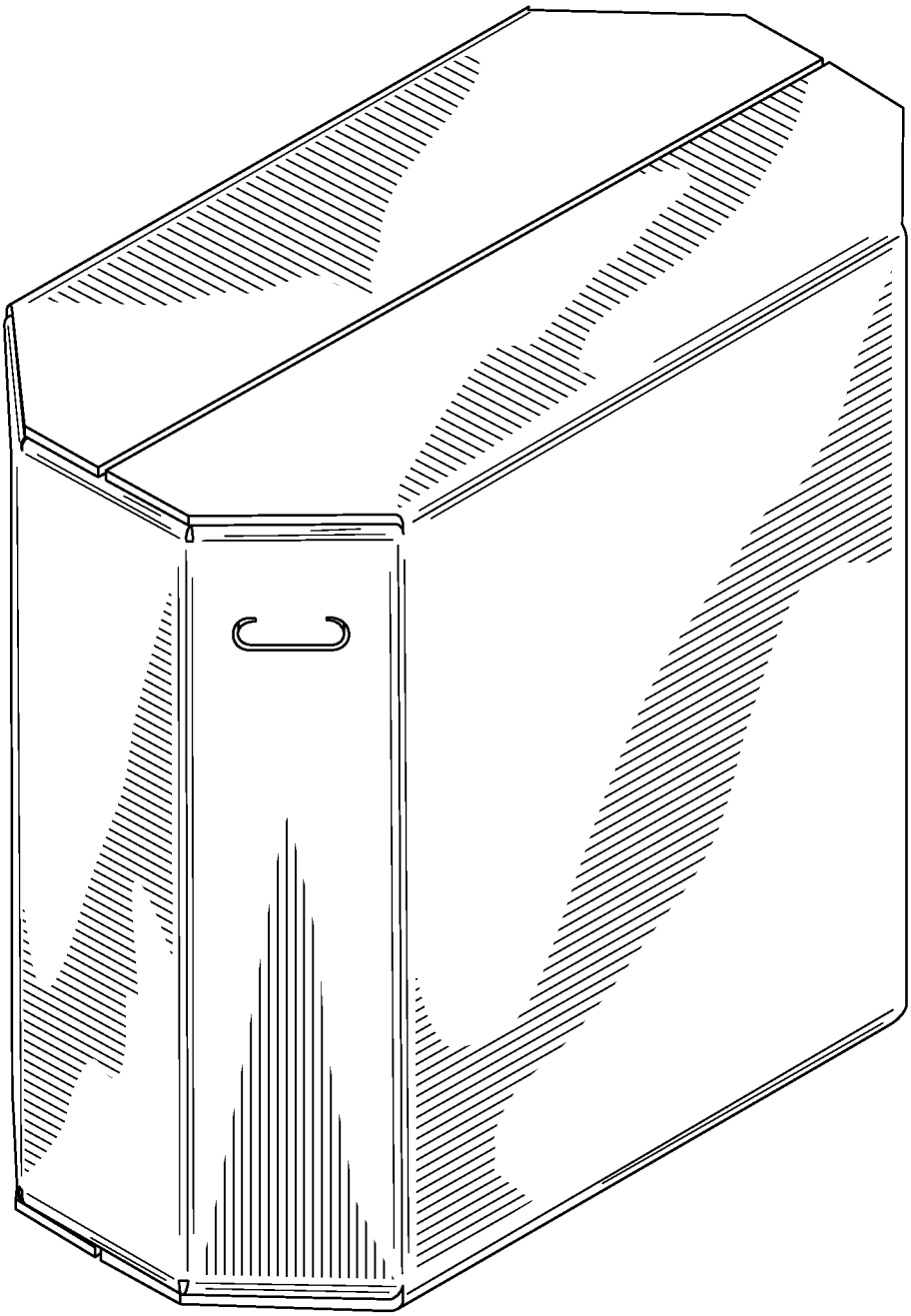
FIG. 49 is a top perspective view of a packaging box according to another exemplary embodiment.
Figure 50:
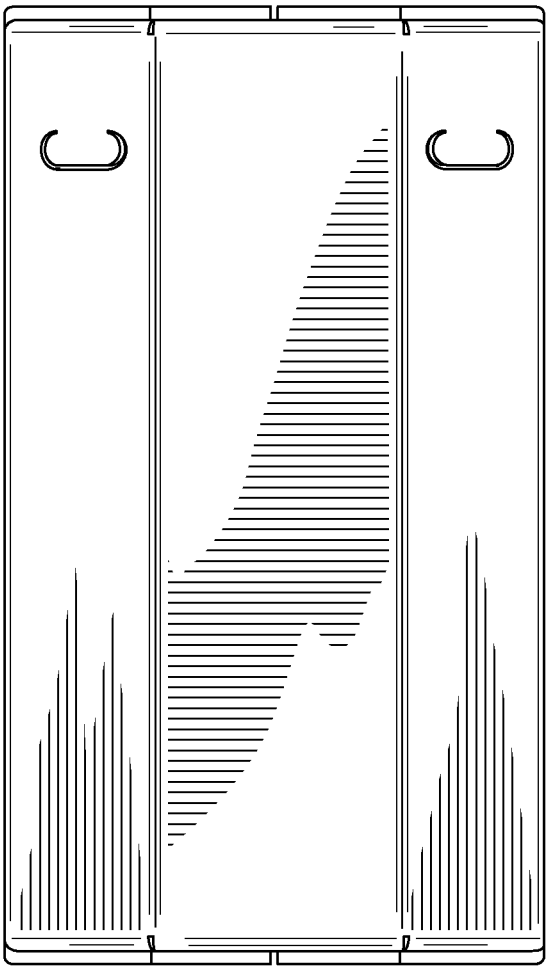
FIG. 50 is a front elevation view of the packaging box of FIG. 49.
Figure 51:
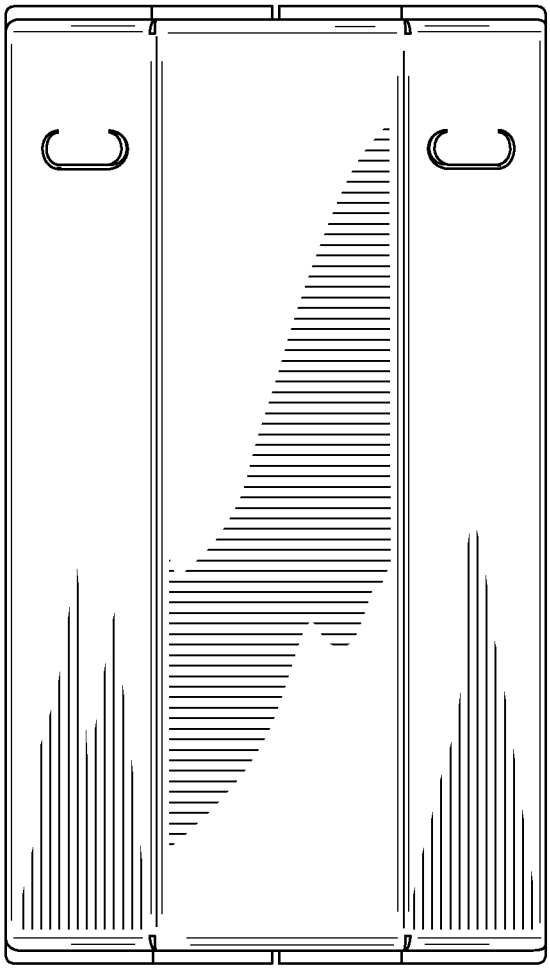
FIG. 51 is a rear elevation view of the packaging box of FIG. 49.
Figure 52:
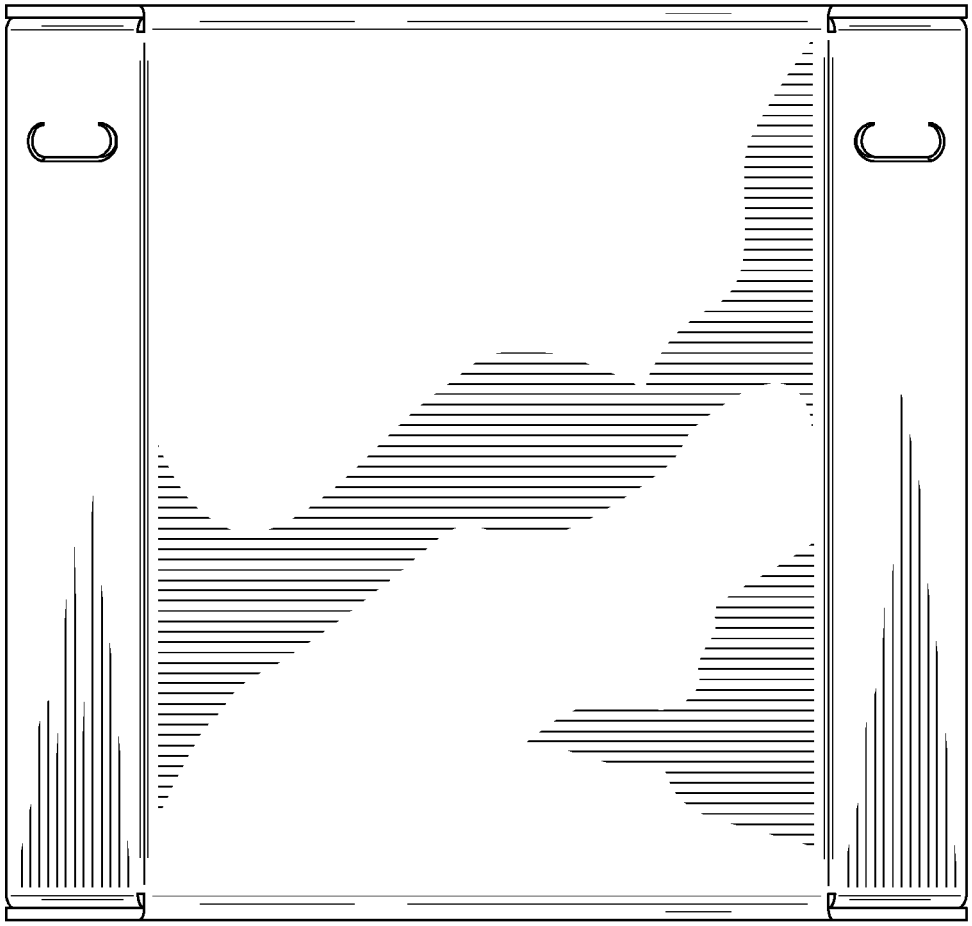
FIG. 52 is a right-side elevation view of the packaging box of FIG. 49.
Figure 53:
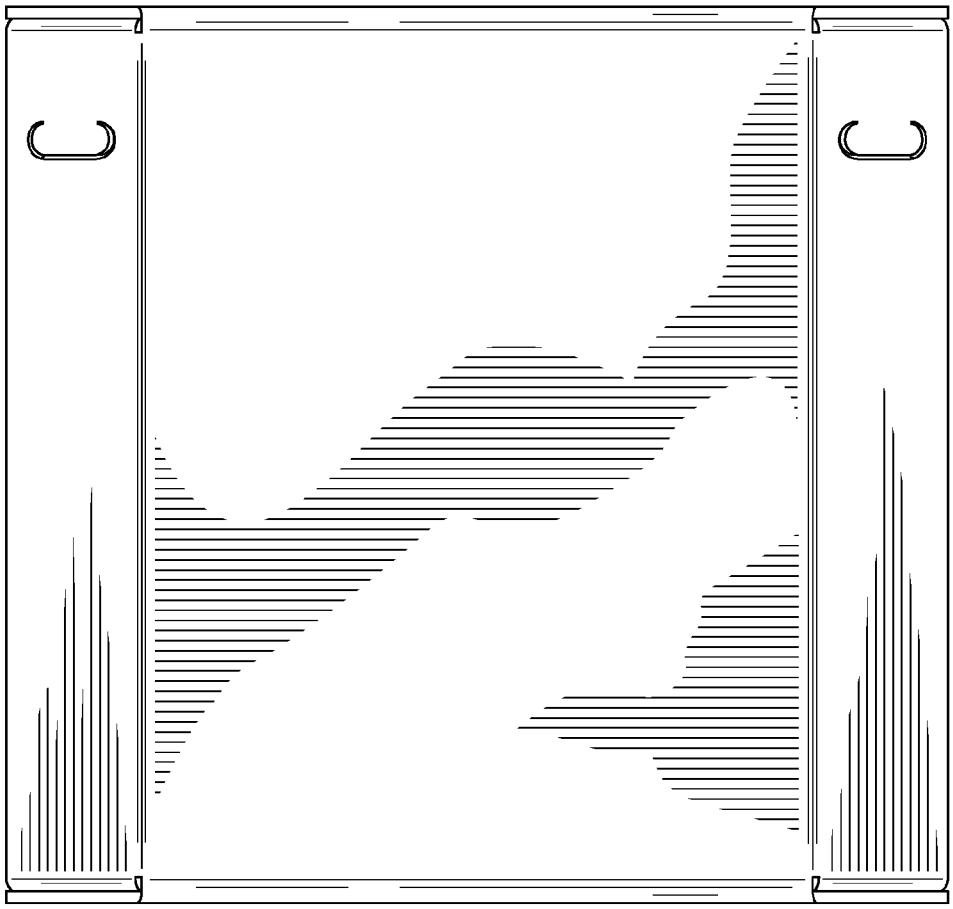
FIG. 53 is a left-side elevation view of the packaging box of FIG. 49.
Figure 54:
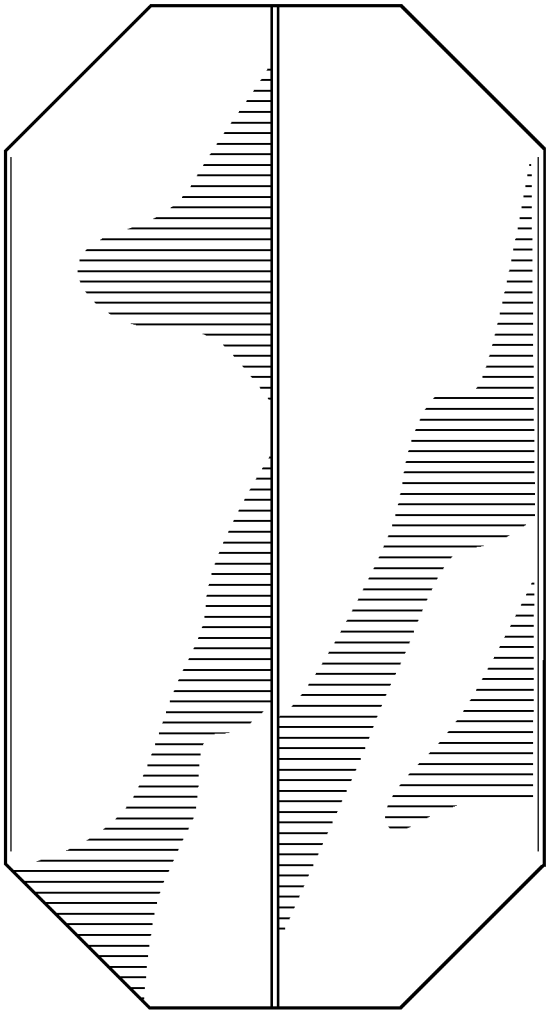
FIG. 54 is a top plan view of the packaging box of FIG. 49.
Figure 55:
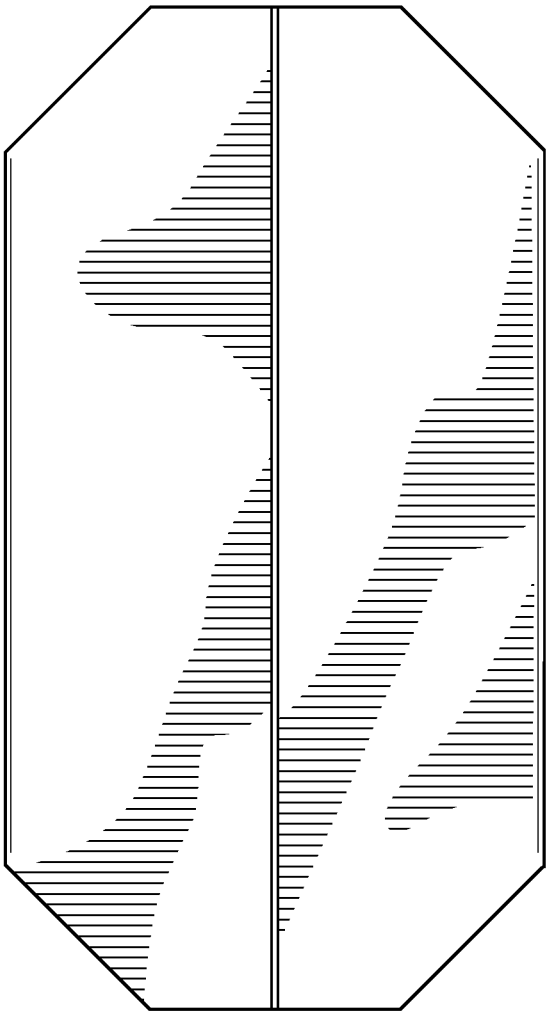
FIG. 55 is a bottom plan view of the packaging box of FIG. 49.
Figure 56:
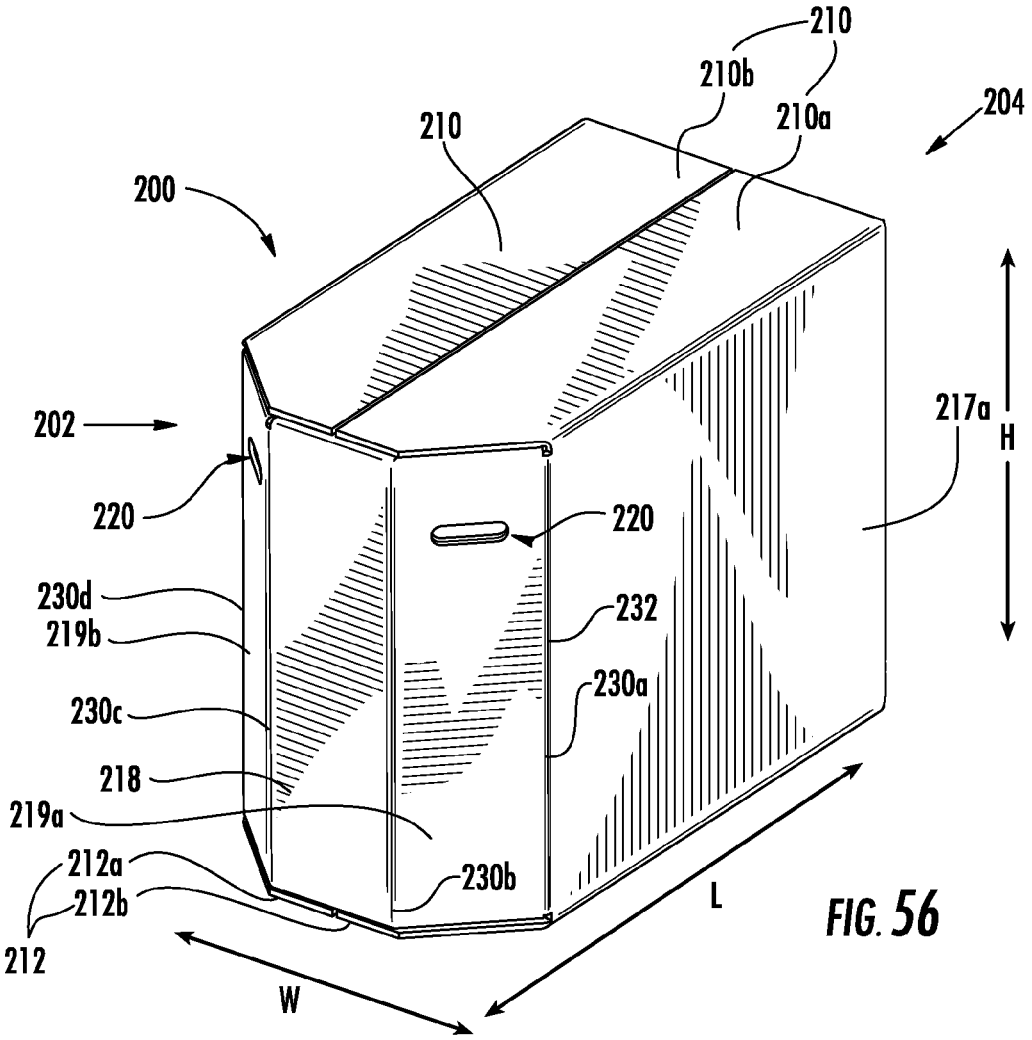
FIG. 56 is a top perspective view of a packaging box according to an exemplary embodiment.
Figure 57:
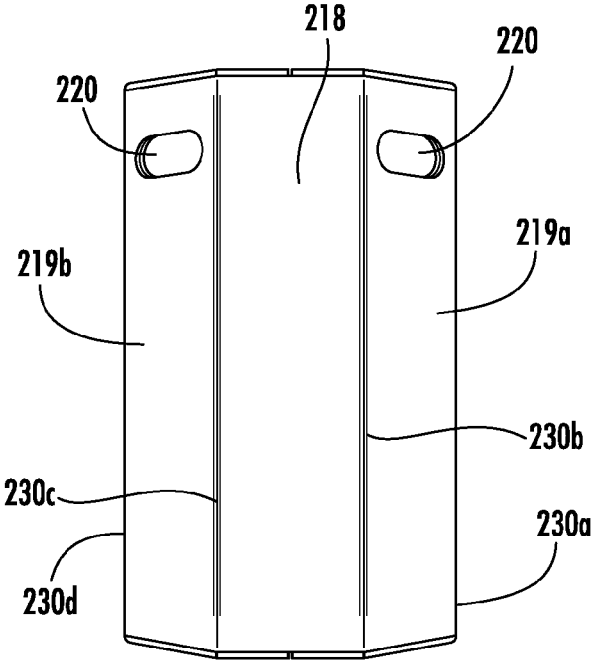
FIG. 57 is an end view of the packaging box of FIG. 56.
Figure 58:
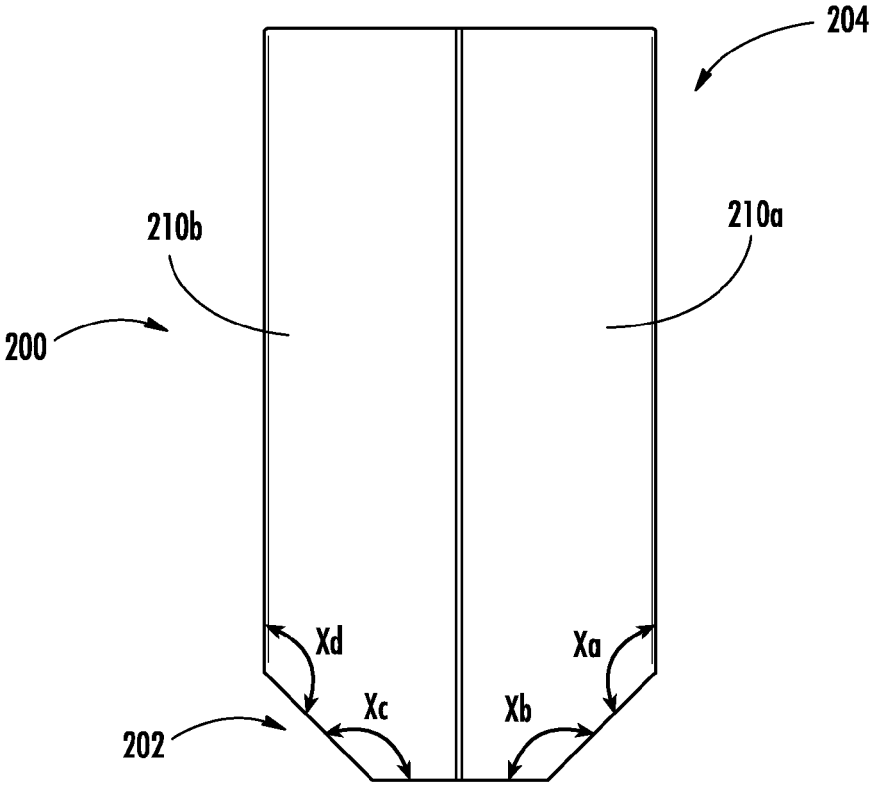
FIG. 58 is a top view of the packaging box of FIG. 56.
Figure 59:
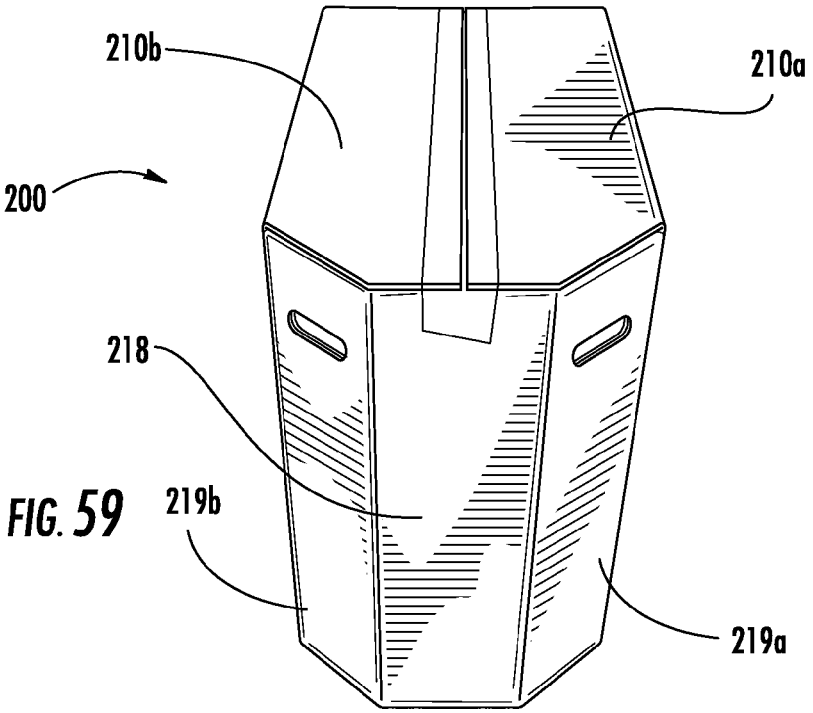
FIG. 59 is an angled top view of the packaging box of FIG. 56.
Figure 60:
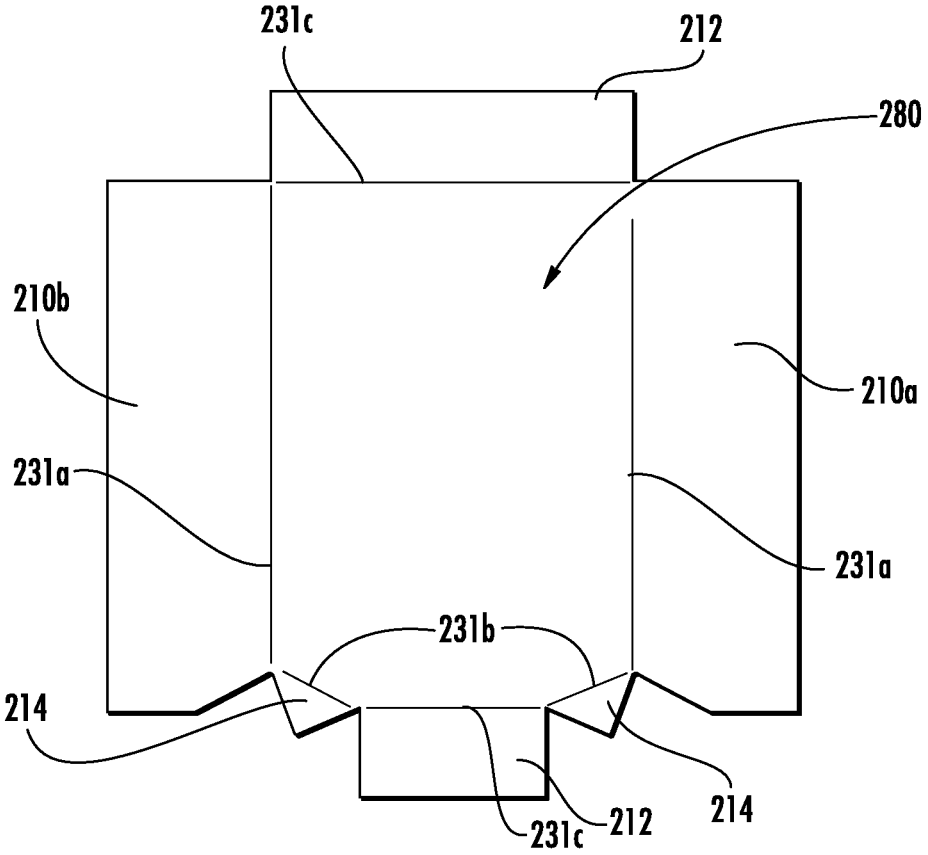
FIG. 60 is a top plan view of the packaging box of FIG. 56 with the lid in an open state.

A further advantage of the packaging box 100 is that its additional vertical corners and faces provide a packaging box 100 that is better for stacking and shipping. In addition, the packaging box 100 has a unique aesthetic look. When packaging boxes 100 are stacked together, for example in the aisle of a store, they may catch the attention of a consumer more than conventional boxes. FIGS. 13 and 65 show exemplary embodiments of a plurality of stacked packaging boxes 100, 200 to demonstrate this effect. The packaging boxes 100, 200 also provides increased surface area for labels, product advertising, and information than conventional packaging, thus improving its aesthetic appeal. For example, configuring the packaging box 100 with an end portion having three vertical surfaces, rather than a single vertical surface as in a conventional rectangular box, provides additional advertising space on the portion of the packaging box 100 that is most likely to be seen by a consumer when walking down an aisle of a store.

Figure 10:
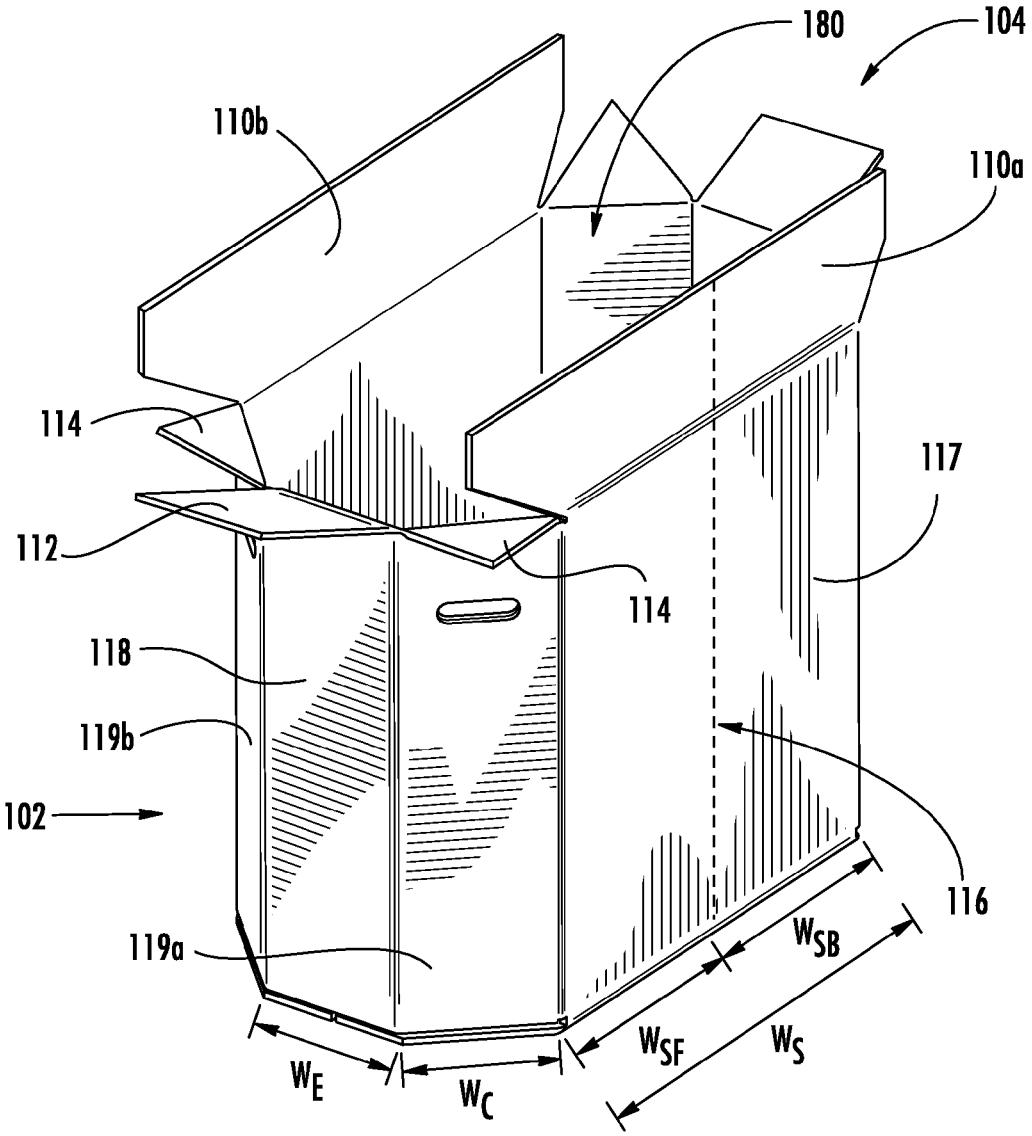
FIG. 10 is a top perspective view of the packaging box of FIG. 9 after the packaging box has been partially assembled.
Figure 62:
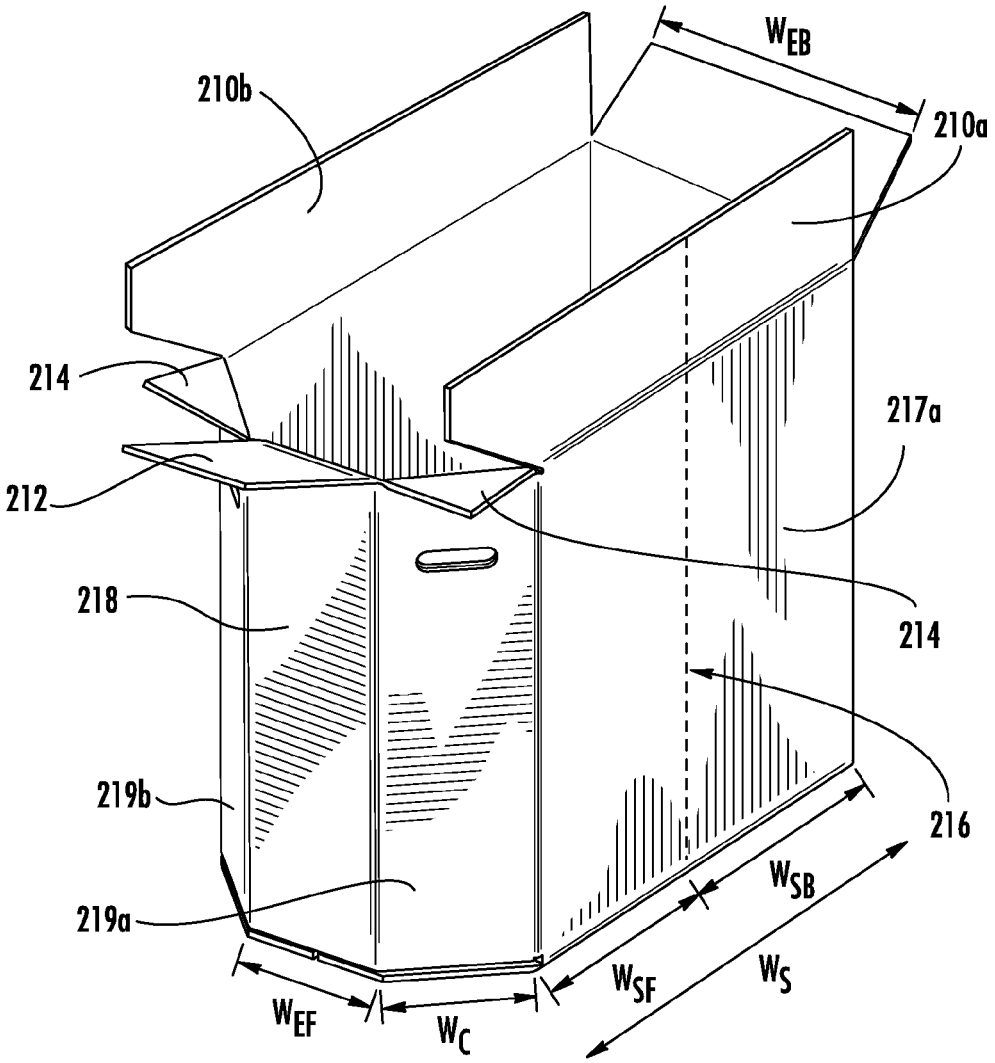
FIG. 62 is a top perspective view of the packaging box of FIG. 9 after the packaging box has been partially assembled.
Figure 63:
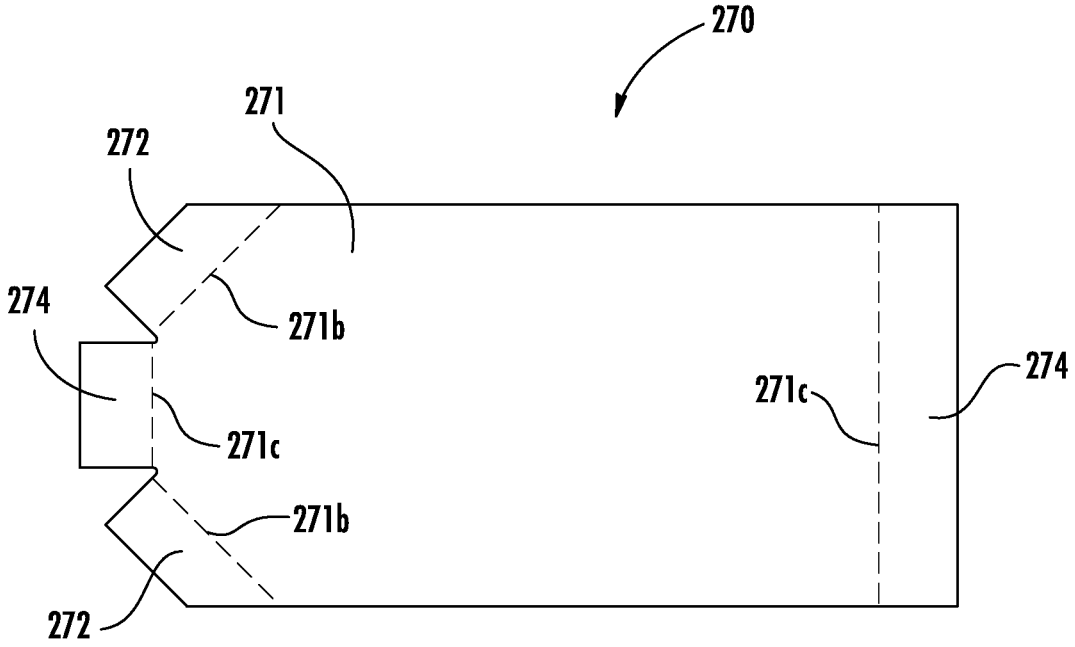
FIG. 63 is a top plan view of a horizontal pad according to an exemplary embodiment.

According to an exemplary embodiment, a packaging box 100 can be provided in a relatively flat, folded state when the packaging box 100 is manufactured, permitting simple transportation and storage of the packaging box 100. Such a folded state can advantageously eliminate folds which create issues with taping and handling. In addition, this folded configuration can avoid perforations at corners and provide a unique scoring and cut pattern which permits the packaging to ship in a flat, folded state prior to assembly. FIG. 9 shows a top view of an embodiment of a packaging box 100 in a relatively flat, folded state. Such a folded state can be achieved by providing a fold line 116 along each side 117 of the packaging box 100. In other words, the sides 117 of a packaging box 100, which can be the longest sides in the length L dimension, can be folded, along with their respective panels or flaps 110*a*, 110*b*, such as by folding the sides 117 and panels 110*a*, 110*b* in half along fold line 116, as shown in the examples of FIGS. 9 and 10. As shown in FIGS. 61A, 61B, and 62, the packaging box 200 may also be folded flat or collapsed, such that side panels 217*a*, 217*b* are folded along creases or fold lines 216, which are biased toward a forward end of the side panels 217, 217*b*.

According to an exemplary embodiment, a method of folding a packaging box 100 is provided. As a first step, a packaging box 100 can be provided in a relatively flat, folded state, such as in the state shown in the embodiment of FIG. 9. In this exemplary folded state, the sides of the packaging box 100 have been folded along line 116 which runs along each side 117 of the packaging box. A packaging box 100 in this relatively flat, folded state may then be prepared for packaging by unfolding the packaging box 100 along the fold line 116 so that the sides 117 and the panels 110*a*, 110*b* are relatively flat and no longer folded, as shown in the embodiment of FIG. 10. This may be accomplished manually by a user or by through the assistance of a machine which unfolds the sides 117 and, as necessary, the flaps 110*a*, 110*b*.

In addition, a user can establish creases at each of the vertical corners 130, such as between the end face 118 and adjacent faces 119 and side faces 117, by bending the end face 118, adjacent faces 119, and side faces 117 relative to one another. If the packaging box 100 has been provided in a state which includes perforations which join parts of the packaging box 100, such as perforations joining flap 114 to either or both of the panels or flaps 110*a* (or 110*b*) and 112, such perforations may be broken to separate such parts, as may be necessary.

A user can next fold in the flaps on the bottom of the packaging box 100, such as by folding in the flaps 111*a*, 111*b*, 112, and 114. Once this is accomplished, the packaging box 100 can be placed on its bottom for further assembly.

At this stage, a user may insert one or more end pads 160 in a packaging box 100. An end pad 160 can be folded along fold lines 161*b*, 161*c* so that the end pad 160 may easily assume the shape of an end of a packaging box 100. For example, an end pad 160 can be folded along the fold lines 161*a*, 161*b* so that a middle panel 160*b* of the end pad 160 corresponds and is inserted adjacent to the end face 118 of a packaging box 100. Such end pads 160 can be used to provide additional reinforcement of a packaging box 100 and to assist in maintaining the shape of a packaging box 100. For example, an end pad can be inserted in each end of a packaging box 100, as shown in the embodiment of FIGS. 7A, 7B. Alternatively, the packaging box 100 can be prepared without inserting one or more end pads 160.

Subsequently, a horizontal pad 170 (shown as being used as a bottom pad in the Figures) can be inserted into the packaging box 100. Any foldable corners 172 and ends 174 of the horizontal pad 170 can be folded, such as by folding the corners 172 and/or ends 174 inward towards what will be an interior of the packaging box 100, and this can be done by a user or machine before the horizontal pad 170 is inserted into the interior of the packaging box 100 or during insertion of the horizontal pad 170 into the packaging box 100. For example, the corners 172 and ends 174 can abut the adjacent faces 119 and end faces 118 when the horizontal pad 170 is placed within an packaging box 100, causing the foldable corners 172 and ends 174 to fold upwards. According to an exemplary embodiment, a packaging box 100 can be assembled with one or more end pads 160 and one or more horizontal pads 170, either of the end pads 160 and the horizontal pad 170, or neither of the end pads 160 and the horizontal pad 170. Subsequently, the packaging box 100 is ready to receive a plumbing fixture or the box 100 can be closed and stored, such as by folding the flaps 110*a*, 110*b*, 112, 114 on the top 110 of the box 100 inward.

According to an exemplary embodiment, a method of packaging a plumbing fixture is provided. A packaging box 100 is first provided, such as in the state shown in the embodiment of FIG. 2, which case the top of the box 100 must be opened, or the packaging box is already provided in the state shown in the embodiment of FIG. 10 with the top open and ready to receive a plumbing fixture within its interior. Next, a plumbing fixture, such as a toilet, can be inserted and placed within the interior of the packaging box 100. The top flaps forming the lid of the packaging box 100 may then be folded shut and sealed so that the packaging box and the plumbing fixtures inside are ready for lifting and transport.

Figure 8:
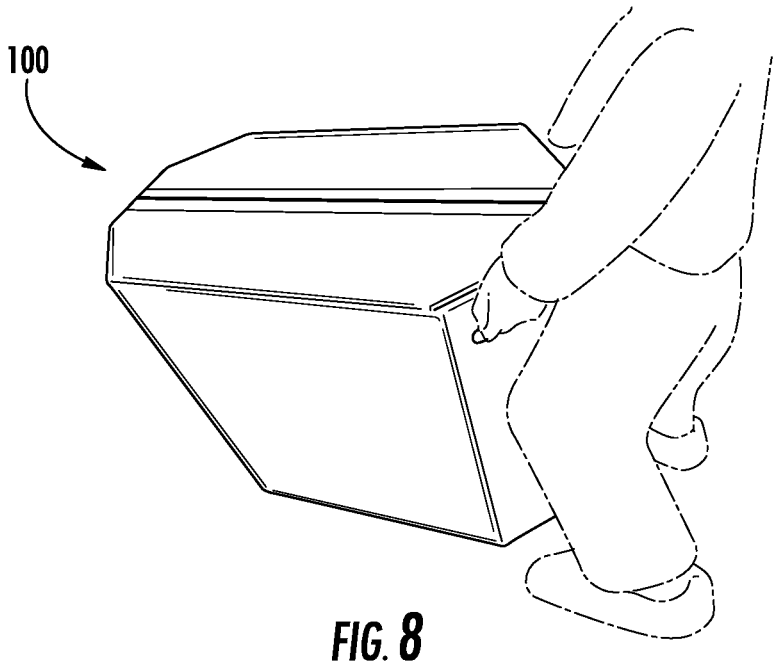
FIG. 8 is a perspective view showing an exemplary method of lifting the packaging box of FIG. 2 according to an exemplary embodiment.

According to an exemplary embodiment, a method of lifting a packaging box is provided, which can be empty or can contain a plumbing fixture inside. A method of lifting a packaging box can be accomplished by a user positioning his or her knees laterally or on either sides of an end face of a packaging box. For example, a packaging box 100 can have a more narrow or tapering end due to the increased number of vertical corners, which permits a user to position his or her knees laterally to the end of the packaging box 100, such as to the sides of the end face or panel 118 of the packaging box 100 shown in the example of FIG. 5, thus providing a more comfortable, ergonomic lifting position than with conventional packaging. The user may then grasp the packaging box, such as by grasping the apertures 120 and/or other grasping features provided on the packaging box, and lift the packaging box, as shown in the example of FIG. 8.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention encompassed by the present disclosure.

References herein to the positions of elements (e.g., "top," "bottom," "above," "below," etc.) are merely used to describe the orientation of various elements in the FIGURES. It should be noted that the orientation of various elements may differ according to other examples, and that such variations are intended to be encompassed by the present disclosure.

It is important to note that the construction and arrangement of the devices shown in the various examples is illustrative only. Although only a few examples have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative examples. Other substitutions, modifications, changes and omissions may also be made in the design, operating conditions and arrangement of the various examples without departing from the scope of the present invention.

What is claimed is:

1. A box for a plumbing fixture, comprising:

a first side panel, a second side panel, a first end panel, a second end panel, a first corner panel, and a second corner panel, which are interconnected to each other at parallel joints;

wherein the first side panel and the first end panel are connected to opposite ends of the first corner panel, the first side panel having a forward end connected to the first corner panel and having a rearward end;

wherein the first corner panel and the second corner panel are connected to opposite ends of the first end panel;

wherein the second side panel and the first end panel are connected to opposite ends of the second corner panel, the second side panel having a forward end connected to the second corner panel and having a rearward end;

wherein the second end panel is connected at respective opposite ends thereof to the rearward end of the first side panel and to the rearward end of the second side panel;

wherein the first corner panel, the second corner panel, and the second end panel each include a respective handle;

wherein in a first configuration, the box is in a collapsed state in which the box is generally planar, the first side panel being folded at a central crease that is closer to the forward end than the rearward end thereof, and the second side panel being folded at a central crease that is closer to the forward end than the rearward end thereof;

wherein in a second configuration, the box is in an expanded state in which (a) a cavity is defined between the first side panel, the second side panel, the first end panel, the second end panel, the first corner panel, and the second corner panel, (b) the first side panel and the second side panel are generally planar, (c) a sum of angles between the first end panel and the first corner panel and between the first end panel and the second corner panel is greater than 180 degrees, and (d) the box is configured to enclose a plumbing fixture.

2. The box of claim 1, further comprising a top panel that is interconnected to the first side panel at an upper joint and a bottom panel that is interconnected to the first side panel at a lower joint;

wherein in the first configuration, the central crease of the first side panel extends through the top panel and the bottom panel; and wherein in the second configuration, the cavity is defined between the first side panel, the second side panel, the first end panel, the second end panel, the first corner panel, the second corner panel, the top panel, and the bottom panel.

3. The box of claim 2, further comprising a second top panel that is interconnected to the second side panel at an upper joint and a bottom panel that is interconnected to the second side panel at a lower joint;

wherein in the collapsed state of the first configuration, the central crease of the second side panel extends through the second top panel and the second bottom panel; and wherein in the expanded state of the second configuration, the cavity is defined between the first side panel, the second side panel, the first end panel, the second end panel, the first corner panel, the second corner panel, the top panel, the bottom panel, the second top panel, and the second bottom panel.

4. The box of claim 3, wherein the top panel includes an end that is generally parallel with and positioned opposite of the upper joint of the first side panel, and the second top panel includes an end that is generally parallel with and positioned opposite of the upper joint of the second side panel; and wherein in the expanded state of the second configuration, the end of the top panel is positioned adjacent the end of the second top panel.

5. The box of claim 1, wherein in the expanded state of the second configuration, the first side panel and the second side panel are generally parallel with each other and are spaced apart to define a width of the box.

6. The box of claim 5, wherein the first end panel, the first corner panel, and the second corner panel each have a width between the parallel joints thereof, and a sum of the widths of the first end panel, the first corner panel, and the second corner panel is greater than the width of the box.

7. The box of claim 1, wherein in the expanded state of the second configuration, the first side panel and the second side panel are generally parallel with each other and are spaced apart by the second end panel to define a width of the box.

8. The box of claim 1, wherein in the expanded state of the second configuration, the first end panel and the second end panel are generally parallel with each other.

9. The box of claim 1, wherein in the expanded state of the second configuration, the sum of angles between the first end panel and the first corner panel and between the first end panel and the second corner panel is between approximately 240 degrees and approximately 300 degrees.

10. The box of claim 9, wherein in the expanded state of the second configuration, the sum of angles between the first end panel and the first corner panel and between the first end panel and the second corner panel is approximately 270 degrees.

11. The box of claim 9, wherein a sum of angles between the first side panel and the second end panel and between the second side panel and the second end panel is approximately 180 degrees.

12. The box of claim 1, wherein a continuous sheet of material forms the first side panel, the second side panel, the first end panel, the first corner panel, and the second corner panel, and the parallel joints are creases in the continuous sheet.

13. The box of claim 1, wherein in the expanded state of the second configuration, a plumbing fixture is positioned within the cavity.

14. A box for a plumbing fixture comprising:

at least five vertical, planar panels which form a cavity therebetween and which define a horizontal outer periphery of the box in a fully-expanded state, the horizontal outer periphery being symmetric about only one vertical plane;

wherein at least three of the vertical, planar panels each include at least one handle, the handles being positioned symmetrically about the one vertical plane and no other vertical plane; and at least two of the handles are positioned on opposite sides of the one vertical plane;

wherein in the fully-expanded state, the box is configured to enclose a plumbing fixture.

15. The box of claim 14, wherein the box comprises six vertical panels, including a first corner panel, a first end panel coupled to the first corner panel, a second corner panel coupled to the first end panel opposite the first corner panel, a first side panel coupled to the first corner panel opposite the first end panel, a second end panel coupled to the first side panel opposite the first corner panel, and a second side panel coupled to the second end panel opposite the first side panel and coupled to the first corner panel opposite the first end panel.

16. The box of claim 15, wherein a sum of angles between the first corner panel and the first end panel and between the second corner panel and the first end panel is between approximately 240 degrees and approximately 300 degrees.

17. The box of claim 16, wherein the sum of angles between the first corner panel and the first end panel and between the second corner panel and the first end panel is approximately 270 degrees.

18. The box of claim 15, wherein a plumbing fixture is positioned in the cavity.

19. The box of claim 15, wherein the first side panel and the second side panel are parallel with each other.

* * * * *